US011699878B2

(12) United States Patent
Mostoller et al.

(10) Patent No.: US 11,699,878 B2
(45) Date of Patent: Jul. 11, 2023

(54) POWER CONNECTOR HAVING A WIRE RELEASE MECHANISM

(71) Applicant: TE Connectivity Services GmbH, Schaffhausen (CH)

(72) Inventors: Matthew Edward Mostoller, Hummelstown, PA (US); Christopher George Daily, Harrisburg, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/518,295

(22) Filed: Nov. 3, 2021

(65) Prior Publication Data

US 2022/0149566 A1 May 12, 2022

Related U.S. Application Data

(60) Provisional application No. 63/110,455, filed on Nov. 6, 2020.

(51) Int. Cl.

| | |
|---|---|
| ***H01R 13/635*** | (2006.01) |
| ***H01R 13/52*** | (2006.01) |
| ***H01R 13/506*** | (2006.01) |

(52) U.S. Cl.

CPC ..... *H01R 13/635* (2013.01); *H01R 13/506* (2013.01); *H01R 13/5205* (2013.01); *H01R 13/5213* (2013.01)

(58) Field of Classification Search

CPC ..... H01R 13/635; H01R 13/506; H01R 13/5205; H01R 13/5213; H01R 4/4836

See application file for complete search history.

(56) References Cited

U.S. PATENT DOCUMENTS

| | | | | |
|---|---|---|---|---|
| 4,842,550 | A | 6/1989 | Fry, Jr. et al. | |
| 5,211,706 | A | 5/1993 | Polgar | |
| 10,367,271 | B1 * | 7/2019 | Wu | H01R 9/24 |
| 10,498,050 | B1 * | 12/2019 | Liang | H01R 4/4845 |

(Continued)

FOREIGN PATENT DOCUMENTS

| | | |
|---|---|---|
| CN | 110994228 A | 4/2020 |
| DE | 44 33 983 A1 | 3/1996 |

(Continued)

OTHER PUBLICATIONS

International Search Report, International Application No. PCT/IB2021/060273, International Filing Date, Nov. 5, 2021.

*Primary Examiner* — Tho D Ta

(57) ABSTRACT

A power connector includes a terminal block holding terminals in terminal channels with terminating ends configured to be electrically coupled to corresponding wires at separable interfaces. The power connector includes a rear insert covering the terminating ends of the terminals having wire ports configured to receive the corresponding wires during a wire poke-in process. The power connector includes biasing members associated with the terminals each including a pusher configured to be biased against the wire to push the wire into direct physical contact with the separable interface of the corresponding terminal. The power connector includes a release mechanism includes a plurality of pusher release elements. The release mechanism is actuated to release the pushers of each of the biasing members from the corresponding wires.

22 Claims, 22 Drawing Sheets

(56) References Cited

U.S. PATENT DOCUMENTS

| | | | | |
|---|---|---|---|---|
| 2002/0146930 | A1 | 10/2002 | Williams | |
| 2003/0066673 | A1* | 4/2003 | Doutaz | H01R 12/515 174/652 |
| 2004/0152355 | A1* | 8/2004 | Rudy | H01R 4/4836 439/438 |
| 2012/0052736 | A1* | 3/2012 | Fukushi | H01R 13/112 439/626 |
| 2020/0176897 | A1* | 6/2020 | Ober-Woerder | H01R 13/187 |

FOREIGN PATENT DOCUMENTS

| | | | |
|---|---|---|---|
| DE | 20 2007 009 193 | U1 | 10/2007 |
| DE | 10 2015 101893 | A1 | 11/2016 |
| EP | 3 128 616 | A1 | 2/2017 |
| EP | 3 709 445 | A1 | 9/2020 |
| WO | 2007/042157 | A1 | 4/2007 |
| WO | 2016 / 083966 | A1 | 6/2016 |
| WO | 2018 / 004482 | A1 | 1/2018 |
| WO | 2019 / 175847 | A1 | 9/2019 |

* cited by examiner

POWER CONNECTOR HAVING A WIRE RELEASE MECHANISM

CROSS REFERENCE TO RELATED APPLICATIONS

This application relates to and claims priority benefits from U.S. Provisional Application No. 63/110,455, entitled "POWER CONNECTOR HAVING A WIRE RELEASE MECHANISM," filed Nov. 6, 2020.

BACKGROUND OF THE INVENTION

The subject matter herein relates generally to power connectors.

Power connectors are used to distribute power in a system, such as in an appliance, a lighting system, an industrial device, a vehicle, and the like. Conventional power connectors use threaded terminal lugs with set screws to connect the line, ground and neutral wires. Such power connectors are time consuming to assembly and disassemble. Additionally, such power connectors have multiple loose components, which may be lost during transport or assembly. Other conventional power connectors use weld tabs to weld the wires to the terminals or crimp barrels on ends of the terminals to crimp the terminals to the wires. However, such terminations are permanent and are not readily disassembled, such as for repair or replacement of parts of the system. Additionally, the power connectors may be used in harsh environments, such as wet or dirty environments, which may lead to failure of the power connector if the power connector becomes wet or dirty.

A need remains for a cost effective and reliable power connector.

BRIEF DESCRIPTION OF THE INVENTION

In one embodiment, a power connector is provided. The power connector includes a terminal block including terminal channels with separating walls between the terminal channels. The terminal block extends between a front and a rear. The power connector includes terminals received in the terminal channels. Each terminal includes a mating end and a terminating end. The mating end is configured for mating with a mating terminal. The terminating ends of the terminals are configured to be electrically coupled to corresponding wires at separable interfaces. The terminating ends are provided at the rear. The power connector includes a rear insert coupled to the rear and covering the terminating ends of the terminals. The rear insert includes wire ports configured to receive the corresponding wires. The wires are configured to be poked into the wire ports to interface with the terminating ends of the terminals. The power connector includes biasing members associated with the terminals. The biasing members are located between the rear of the terminal block and the rear insert. Each biasing member includes a pusher configured to be biased against the wire to push the wire into direct physical contact with the separable interface at the terminating end of the corresponding terminal. The power connector includes a release mechanism includes a plurality of pusher release elements. Each pusher release element is associated with the pusher of the corresponding biasing member. The release mechanism is actuated to release the pushers of each of the biasing members from the corresponding wires.

In another embodiment, a power connector is provided. The power connector includes a terminal block including terminal channels with separating walls between the terminal channels. The terminal block extending between a front and a rear. The power connector includes terminals received in the terminal channels. Each terminal includes a mating end and a terminating end. The mating end is configured for mating with a mating terminal. The terminating ends of the terminals are configured to be electrically coupled to corresponding wires at separable interfaces. The terminating ends are provided at the rear. The power connector includes a rear insert coupled to the rear and covering the terminating ends of the terminals. The rear insert includes wire ports configured to receive the corresponding wires. The wires are configured to be poked into the wire ports to interface with the terminating ends of the terminals. The power connector includes biasing members associated with the terminals. The biasing members are located between the rear of the terminal block and the rear insert. Each biasing member includes a pusher configured to be biased against the wire to push the wire into direct physical contact with the separable interface at the terminating end of the corresponding terminal. The power connector includes a release mechanism including a plurality of pusher release elements. Each pusher release element is associated with the pusher of the corresponding biasing member. The release mechanism is actuated to release the pushers of each of the biasing members from the corresponding wires. The release mechanism is slidably coupled to the rear insert. The release mechanism slides between an unactuated position and an actuated position. The pusher release elements move each of the pushers when the release mechanism is moved from the unactuated position to the actuated position.

In a further embodiment, a power connector is provided. The power connector includes a terminal block including terminal channels with separating walls between the terminal channels. The terminal block extends between a front and a rear. The power connector includes terminals received in the terminal channels. Each terminal includes a mating end and a terminating end. The mating end is configured for mating with a mating terminal. The terminating ends of the terminals are configured to be electrically coupled to corresponding wires at separable interfaces. The terminating ends are provided at the rear. The power connector includes a rear insert coupled to the rear and covering the terminating ends of the terminals. The rear insert includes wire ports configured to receive the corresponding wires. The wires are configured to be poked into the wire ports to interface with the terminating ends of the terminals. The power connector includes biasing members associated with the terminals. The biasing members are located between the rear of the terminal block and the rear insert. Each biasing member includes a pusher configured to be biased against the wire to push the wire into direct physical contact with the separable interface at the terminating end of the corresponding terminal. The power connector includes a release mechanism including a plurality of pusher release elements. Each pusher release element is associated with the pusher of the corresponding biasing member. The release mechanism is actuated to release the pushers of each of the biasing members from the corresponding wires. The power connector includes a cable cover assembly having a chamber receiving the terminal block. The cable cover assembly includes a threaded protrusion having a cable bore configured to receive a cable includes the wires in a wire bundle. The wires exiting through the cable bore. The cable cover assembly includes a sealing grommet received in the cable bore to seal between the threaded protrusion and the cable. The cable cover assembly includes a sealing nut coupled to the threaded protrusion to clamp the threaded protrusion to the cable.

DETAILED DESCRIPTION OF THE INVENTION

Figure 1:
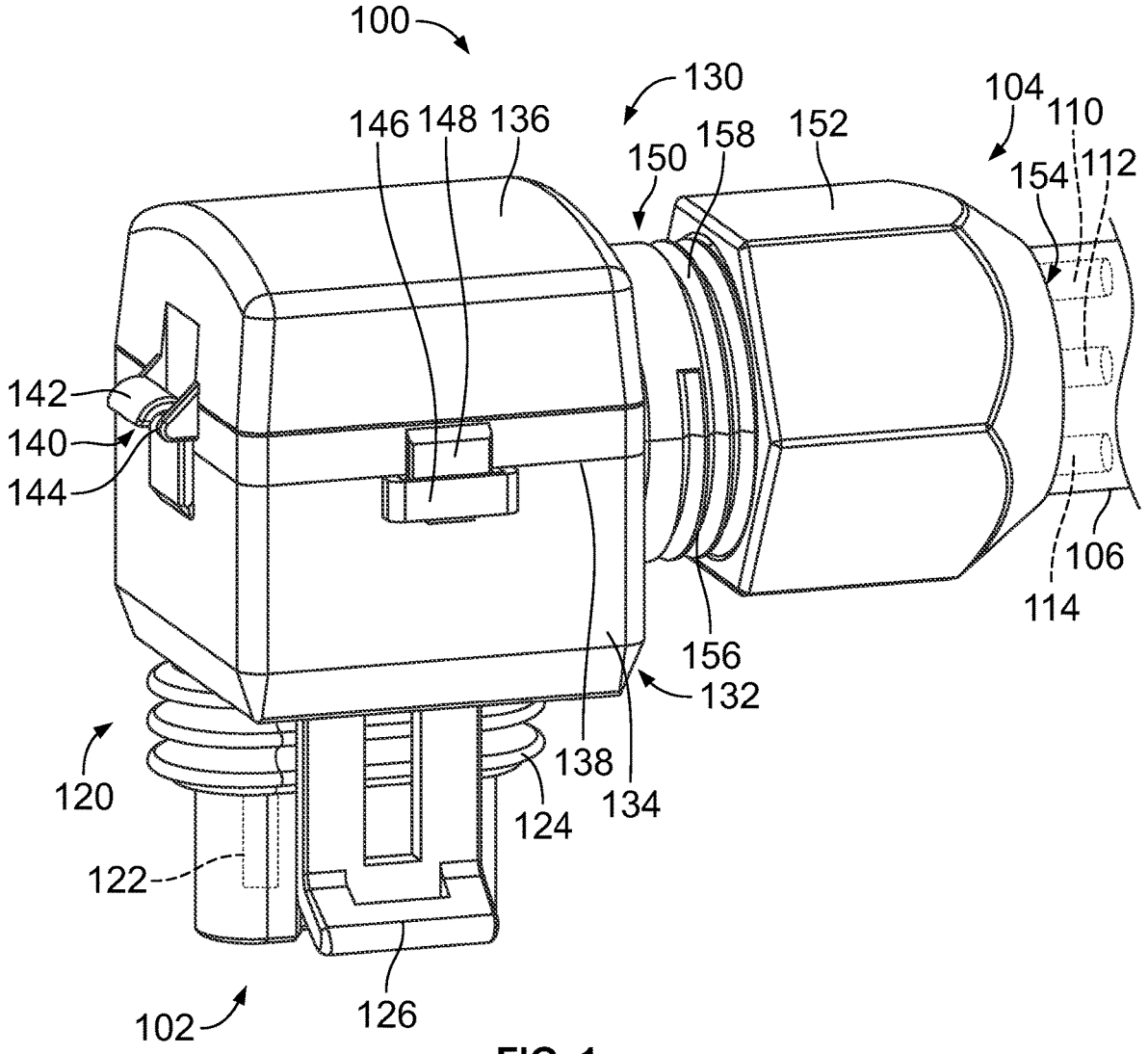
FIG. 1 illustrates a power connector in accordance with an exemplary embodiment.

FIG. 1 illustrates a power connector 100 in accordance with an exemplary embodiment. The power connector 100 extends between a mating end 102 and a cable end 104. The mating end 102 is configured to be mated with a mating power connector (not shown). The mating power connector may be included in a device or system, such as an appliance, a lighting device, and industrial device, a vehicle, and the like. The power connector 100 supplies power to the device or system through the mating power connector. A power cable 106 extends from the cable end 104 to supply power to the power connector 100. In an exemplary embodiment, the power cable 106 is a multi-wire power cable including multiple wires within a wire bundle within the power cable 106. For example, the power cable 106 includes an outer jacket 108 surrounding the wire bundle. In an exemplary embodiment, the wire bundle of the power cable 106 includes a line wire 110, a neutral wire 112, and a ground wire 114.

In an exemplary embodiment, the power connector 100 provides a sealed mating interface with the mating power connector and a sealed interface with the power cable 106. The power connector 100 is suitable for use in harsh environments, such as wet or dirty environments. The sealed interfaces prevent ingress of moisture, water or debris into the interior of the power connector 100. In an exemplary embodiment, the power connector 100 includes a terminal holder 120 holding a plurality of terminals 122 (shown in phantom). The terminals 122 are configured to be mated with the mating power connector. The terminals 122 are terminated to ends of the wires 110, 112, 114. The terminal holder 120 is manufactured from a dielectric material, such as a plastic material to hold the terminals 122. The power connector 100 includes a front seal 124 around the exterior of the terminal holder 120. The front seal 124 is configured to be sealed to the mating power connector. For example, the mating end of the terminal holder 120 and the front seal 124 may be plugged into a socket or housing of the mating power connector during mating. The power connector 100 includes a latch 126 for latchably coupling the power connector 100 to the mating power connector.

In an exemplary embodiment, the power connector 100 includes a cable cover assembly 130 at least partially surrounding the terminal holder 120 and at least partially surrounding the end of the power cable 106. For example, the cable cover assembly 130 includes a shell 132 surrounding a portion of the terminal holder 120. The power cable 106 extends into the shell 132. In an exemplary embodiment, the shell 132 is a multipiece shell including a front cover 134 and a rear cover 136. The front cover 134 is coupled to the rear cover 136 at a seam 138. In an exemplary embodiment, the cable cover assembly 130 includes a seal at the seam 138 to provide a sealed interface between the front cover 134 and the rear cover 136. In an exemplary embodiment, the front cover 134 is hingedly coupled to the rear cover 136 at a hinge 140. For example, the front cover 134 may include a hook 142 and the rear cover 136 may include a rod 144 received in the hook 142. Other types of hinges may be used in alternative embodiments. In other various embodiments, the front cover 134 may be secured to the rear cover 136 using other securing means, such as clips, fasteners, latches, and the like. In the illustrated embodiment, the front cover 134 includes one or more latching features 146, such as along the sides, and the rear cover 136 includes corresponding latching features 148, such as along the sides. The latching features 146 are latchably coupled to the latching features 148.

In an exemplary embodiment, the cable cover assembly 130 includes a protrusion 150 at the cable end 104. Optionally, the protrusion 150 may be a threaded protrusion. A securing element 152 is configured to be coupled to the protrusion 150 to secure the front cover 134 to the rear cover 136 along the protrusion 150. For example, the securing element 152 may be a sealing nut and may be referred to hereinafter as a sealing nut 152. However, other types of securing elements may be used in alternative embodiments, such as a zip tie.

The sealing nut 152 is threadably coupled to the threaded protrusion 150. For example, the threaded protrusion 150 include external threads and the sealing nut 152 is threaded onto the threaded protrusion 150. The threaded protrusion 150 may include a cable bore 154 extending therethrough. The power cable 106 is received in the cable bore 154. The sealing nut 152 may be used to clamp the threaded protrusion 150 around the exterior of the outer jacket 108 of the power cable 106. For example, the threaded protrusion 150 may be compressed inward as the sealing nut 152 is tightened onto the threaded protrusion 150. In an exemplary embodiment, the threaded protrusion 150 is formed by the front cover 134 and the rear cover 136. For example, the front cover 134 may include a front portion 156 and the rear cover 136 may include a rear portion 158. The front portion 156 and the rear portion 158 together form the threaded protrusion 150. The front portion 156 meets the rear portion 158 at the seam 138. The sealing nut 152 secures the front portion 156 to the rear portion 158.

Figure 2:
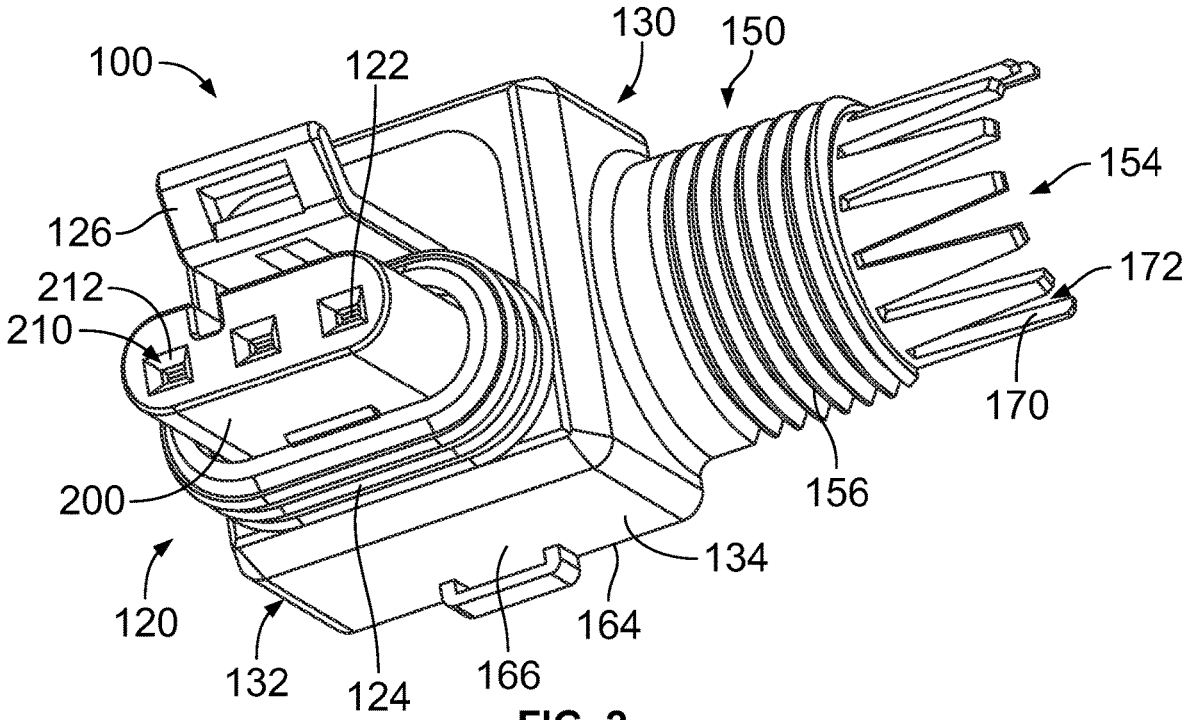
FIG. 2 is a front perspective view of a portion of the power connector showing the terminal holder received in the front cover of the cable cover assembly in accordance with an exemplary embodiment.
Figure 3:
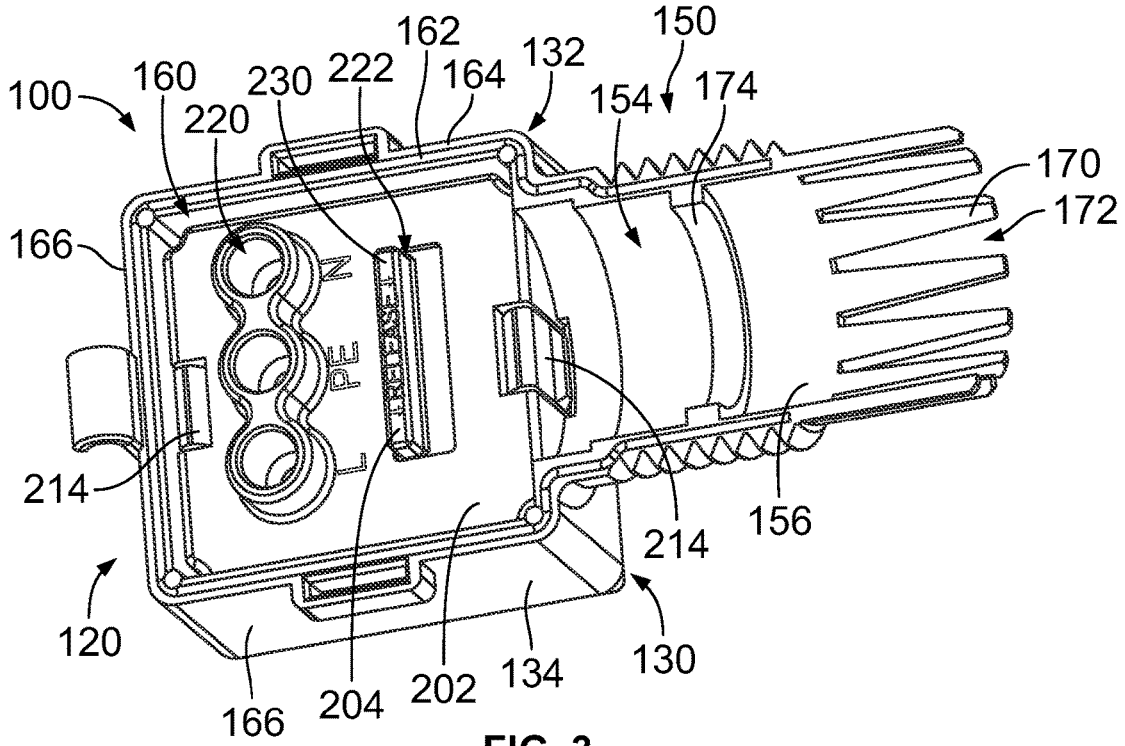
FIG. 3 is a rear perspective view of a portion of the power connector showing the terminal holder received in the front cover of the cable cover assembly in accordance with an exemplary embodiment.
Figure 4:
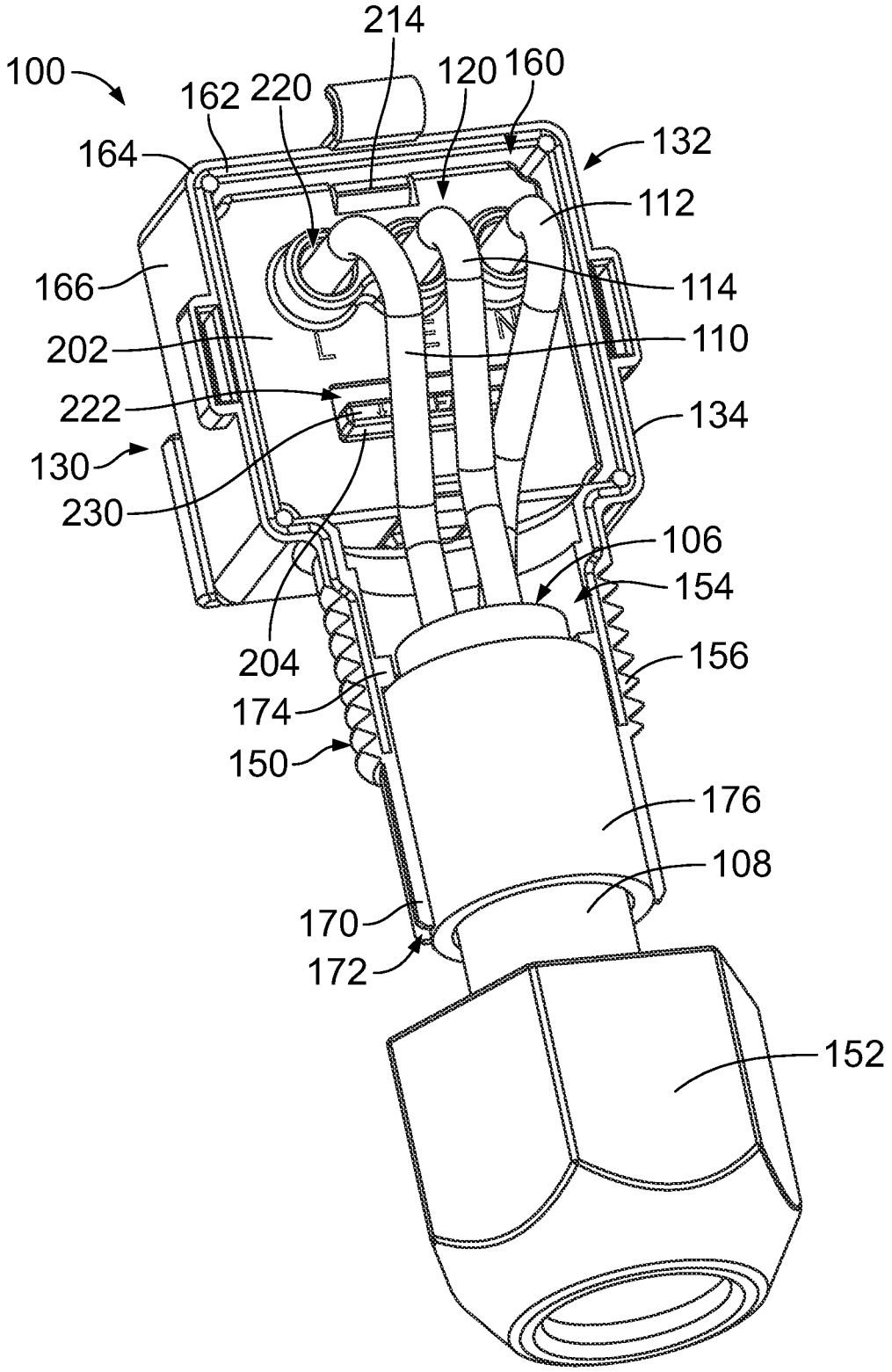
FIG. 4 is a rear perspective view of a portion of the power connector showing the terminal holder received in the front cover of the cable cover assembly in accordance with an exemplary embodiment.

FIG. 2 is a front perspective view of a portion of the power connector 100 showing the terminal holder 120 received in the front cover 134 of the cable cover assembly 130. FIG. 3 is a rear perspective view of a portion of the power connector 100 showing the terminal holder 120 received in the front cover 134 of the cable cover assembly 130. FIG. 4 is a rear perspective view of a portion of the power connector 100 showing the terminal holder 120 received in the front cover 134 of the cable cover assembly 130. FIGS. 2 and 3 have the rear cover 136 and the power cable 106 (both shown in FIG. 1) removed for clarity to illustrate the terminal holder 120 and the front cover 134. FIG. 4 has the rear cover 136 removed for clarity, but illustrates the power cable 106 and the wires 110, 112, 114 coupled to the terminal holder 120.

The shell 132 forms a chamber 160 that receives the terminal holder 120. The chamber 160 is sized and shaped to receive and hold the terminal holder 120 within the interior of the shell 132. The chamber 160 opens to the cable bore 154 to allow the wires and the cable to exit from the cable cover assembly 130. In an exemplary embodiment, the chamber 160 is sealed by a perimeter seal 162 extending around the perimeter of the front cover 134, such as at edges 164 of perimeter walls 166 of the front cover 134. The perimeter seal 162 is configured to interface with the rear cover 136 when the rear cover 136 is coupled to the front cover 134. The perimeter seal 162 may be manufactured from a polymer material, such as a rubber material. The perimeter seal 162 may be compressible between the front cover 134 and the rear cover 136 when the cable cover assembly 130 is assembled. The perimeter seal 162 may extend along the front portion 156 of the threaded protrusion 150.

In an exemplary embodiment, the front portion 156 of the threaded protrusion 150 includes fingers 170 at the distal end of the front portion 156. The fingers 170 are separated by gaps 172. The fingers 170 are independently movable, such as for clamping to the outer jacket 108 of the power cable 106. The fingers 170 may be compressed inward when the sealing nut 152 (FIG. 4) is tightened onto the threaded protrusion 150. In an exemplary embodiment, the front portion 156 includes a rib 174 extending at least partially circumferentially around the cable bore 154. The rib 174 extends radially inward into the cable bore 154. The rib 174 may be used to position the wires within the cable bore 154. The rib 174 may form a stop surface for the outer jacket 108 to locate the outer jacket 108 and the cable bore 154. The rib 174 may form a locating surface for locating another component in the cable bore 154, such as a cable seal 176 within the cable bore 154. In various embodiments, the cable seal 176 may be a sealing grommet and may be referred to hereinafter as a sealing grommet 176. The sealing grommet 176 may abut against the rib 174 to position the sealing grommet 176 in the cable bore 154. The fingers 170 may extend along the sealing grommet 176. When the sealing nut 152 is tightened, the fingers 170 may be compressed inward against the sealing grommet 176, such as to seal the sealing grommet 176 against the outer jacket 108.

The terminal holder 120 holds the terminals 122 and is configured to receive ends of the wires 110, 112, 114 to create electrical connections between the wires 110, 112, 114 in the terminals 122. In an exemplary embodiment, the terminal holder 120 is a multipiece housing. For example, the terminal holder 120 includes a terminal block 200 at a front of the terminal holder 120 and a rear insert 202 at a rear of the terminal holder 120. In an exemplary embodiment, a release mechanism 204 is coupled to the terminal block 200 and/or the rear insert 202 to release the wires 110, 112, 114 from the terminal holder 120. In an exemplary embodiment, the single release mechanism 204 is used to release all of the wires 110, 112, 114. For example, upon actuation of the release mechanism 204, all of the wires 110, 112, 114 may be simultaneously released from the terminal holder 120.

The terminal block 200 includes terminal channels 210 receiving the terminals 122. The terminal channels 210 are open at the front of the terminal block 200 to receive mating power terminals of the mating power connector. The terminal channels 210 may include lead in surfaces 212 at the front to guide the mating terminals into the terminal channels 210. The terminal block 200 is manufactured from a dielectric material, such as a plastic material, to electrically isolate the terminals 122 from each other. In various embodiments, the terminal block 200 is a molded part, such as being manufactured from an injection molding process. The front of the terminal block 200 extend forward of the cable cover assembly 130 for mating with the mating power connector. For example, the front of the terminal block 200 may be plugged into the mating power connector. The front seal 124 extends around the terminal block 200 is located forward of the cable cover assembly 130. In an exemplary embodiment, the latch 126 extends from the terminal block 200.

The rear insert 202 is coupled to a rear end of the terminal block 200. For example, latches 214 at the rear of the terminal block 200 may be used to latchably couple the rear insert 202 to the terminal block 200. Other types of securing features may be used in alternative embodiments, such as clips, fasteners, and the like to secure the rear insert 202 to the terminal block 200. The rear insert 202 includes wire ports 220 that receive the wires 110, 112, 114. In an exemplary embodiment, the wires 110, 112, 114 are poked into the wire ports 220 to mate with the terminals 122. In the illustrated embodiment, the wire ports 220 are arranged in a row. However, other arrangements are possible in alternative embodiments. In an exemplary embodiment, the rear insert 202 includes an opening 222. The release mechanism 204 extends through the opening 222 and is accessible rearward of the rear insert 202 for actuation by a user. For example, a lever 230 of the release mechanism 204 may extend through the opening 222. The user may actuate lever 230 to release the release mechanism 204. For example, the lever 230 to may be pressed downward to slide or rotate the release mechanism 204 from an unactuated position to an actuated position. A separate return mechanism may be used to return the release mechanism 204 to the un-actuated position when the lever 230 is released.

Figure 5:
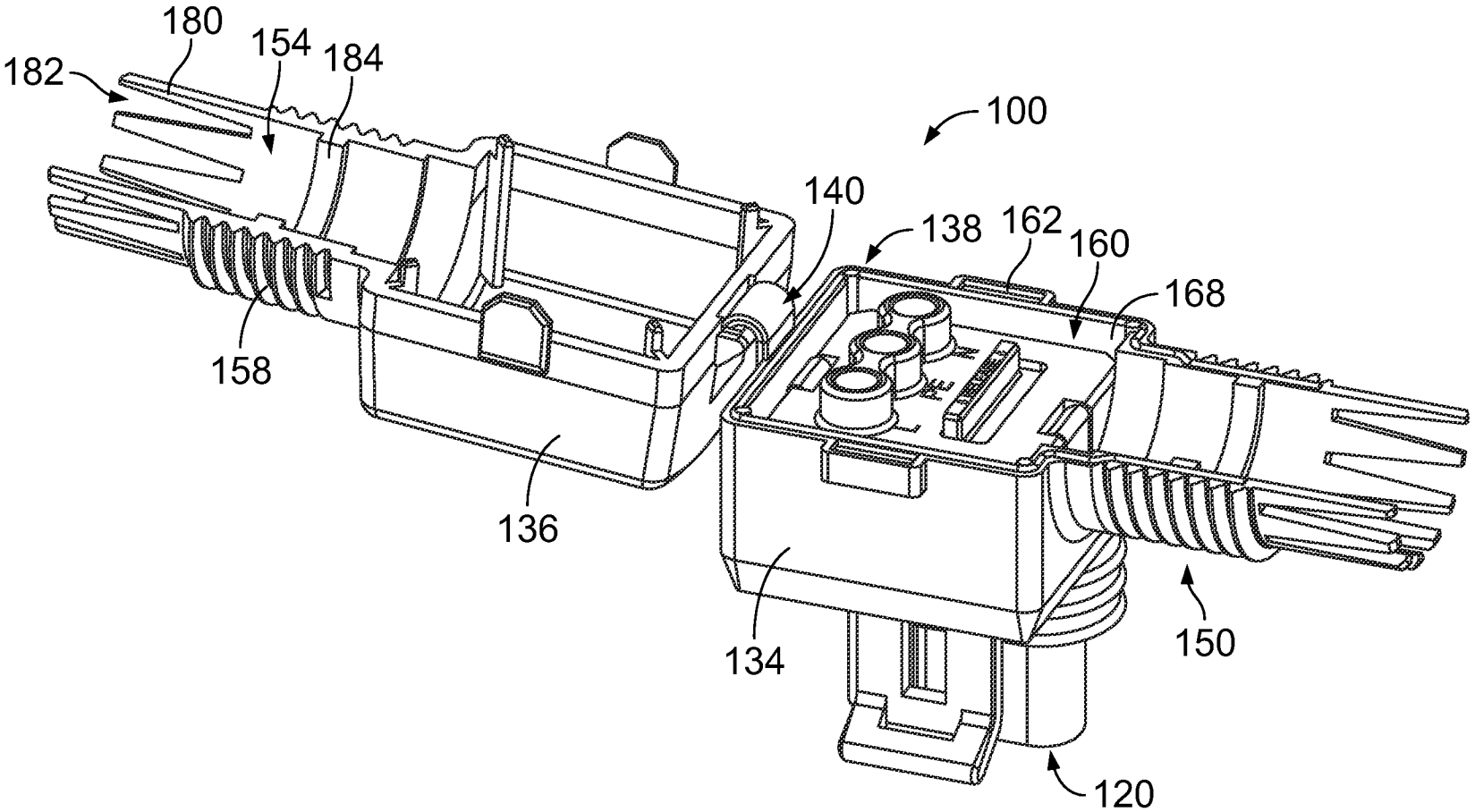
FIG. 5 is a perspective view of a portion of the power connector showing the rear cover in an open position in accordance with an exemplary embodiment.
Figure 6:
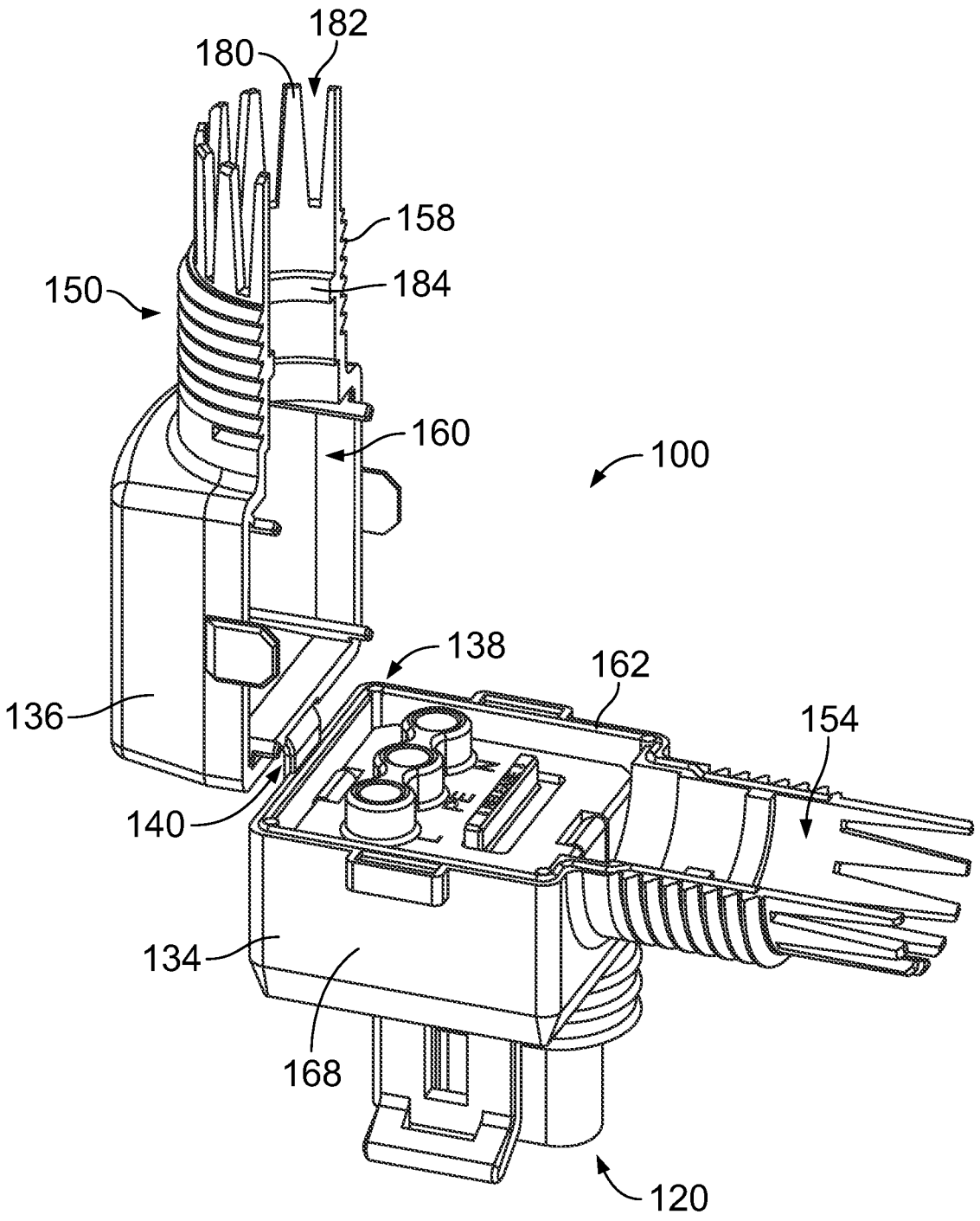
FIG. 6 is a perspective view of a portion of the power connector showing the rear cover in a partially closed position in accordance with an exemplary embodiment.

FIG. 5 is a perspective view of a portion of the power connector 100 showing the rear cover 136 in an open position. FIG. 6 is a perspective view of a portion of the power connector 100 showing the rear cover 136 in a partially closed position. In an exemplary embodiment, the rear cover 136 is hingedly coupled to the front cover 134 at the hinge 140. The rear cover 136 is rotated from the open position to a closed position (shown in FIG. 1).

The rear cover 136 forms part of the chamber 160 and part of the cabled bore 154. Perimeter walls 168 of the rear portion 158 surround the chamber 160. The rear portion 158 extends from the perimeter walls 168. The perimeter walls 168 are configured to engage the perimeter seal 162 at the seam 138 to seal the rear cover 136 to the front cover 134. The chamber 160 in the rear cover 136 provides an open space for routing the wires 110, 112, 114 from the cabled bore 154 to the terminal holder 120.

In an exemplary embodiment, the rear portion 158 of the threaded protrusion 150 includes fingers 180 at the distal end of the rear portion 158. The fingers 180 are separated by gaps 182. The fingers 180 are independently movable, such as for clamping to the outer jacket 108 of the power cable 106. The fingers 180 may be compressed inward when the sealing nut 152 (FIG. 4) is tightened onto the threaded protrusion 150. In an exemplary embodiment, the rear portion 158 includes a rib 184 extending at least partially circumferentially around the cable bore 154. The rib 184 extends radially inward into the cable bore 154. The rib 184 may be used to position the wires within the cable bore 154. The rib 184 may form a stop surface for the outer jacket 108 to locate the outer jacket 108 and the cable bore 154. The rib 184 may form a locating surface for locating another component in the cable bore 154, such as the sealing grommet 176 (shown in FIG. 4) within the cable bore 154.

Figure 7:
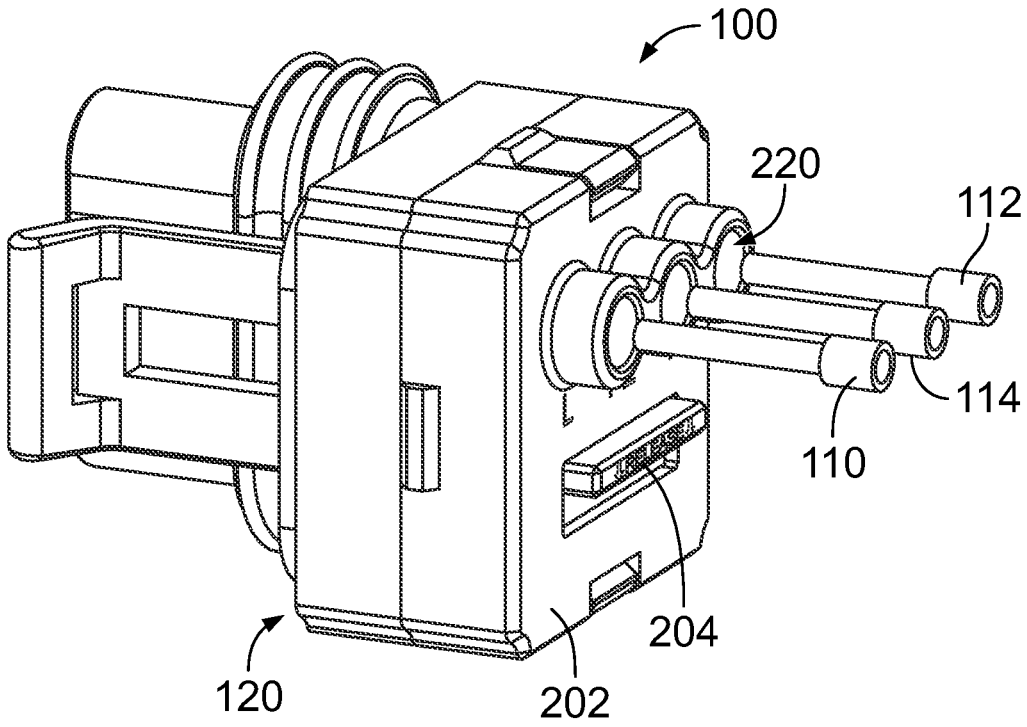
FIG. 7 is a rear perspective view of a portion of the power connector showing the wires poised for loading into the terminal holder in accordance with an exemplary embodiment.

FIG. 7 is a rear perspective view of a portion of the power connector 100 showing the wires 110, 112, 114 poised for loading into the terminal holder 120. The wires 110, 112, 114 may be poked into the wire ports 220 at the rear of the rear insert 202 In a wire loading direction. Optionally, the wire ports 220 may be oversized relative to the wires 110, 112, 114 to guide loading of the wires 110, 112, 114 into the wire ports 220. Ends of the wires 110, 112, 114 are stripped to expose conductors of the wires 110, 112, 114, which are loaded into the wire ports 220 for electrical connection with the terminals 122. Optionally, the release mechanism 204 may be actuated to allow easier insertion of the wires 110, 112, 114 into the terminal holder 120.

Figure 8:
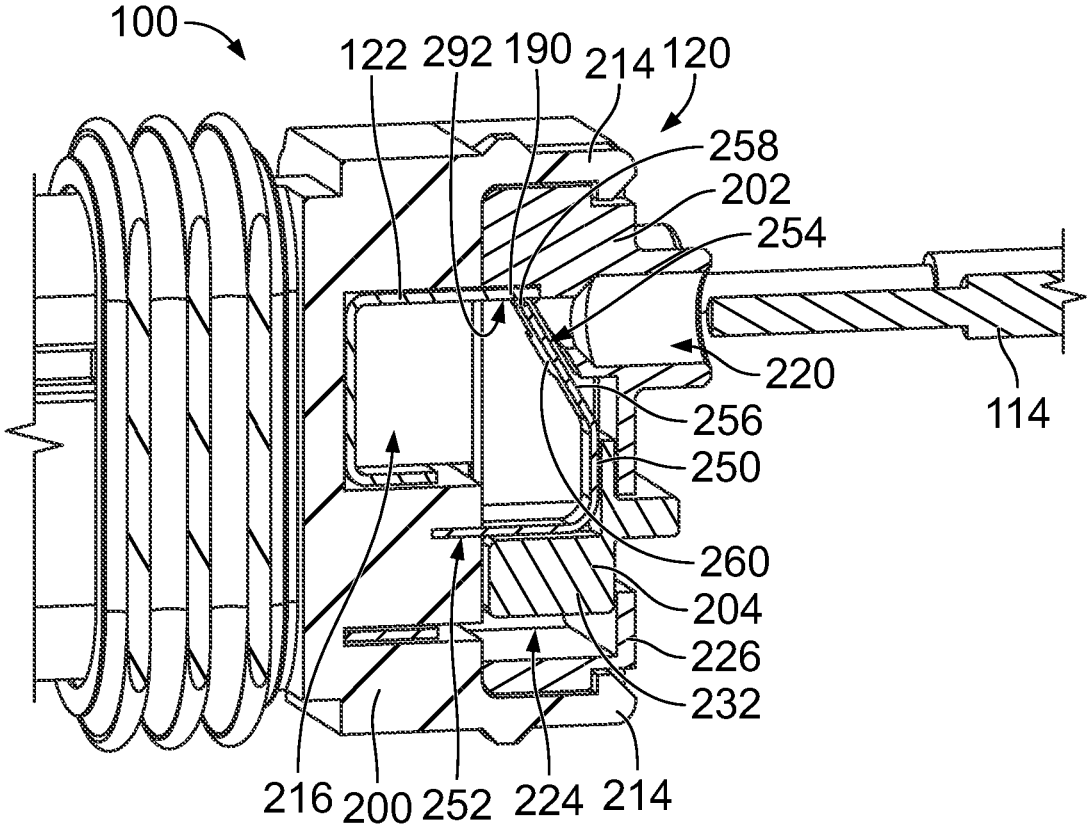
FIG. 8 is a cross-sectional view of a portion of the power connector showing the wire poised for loading into the terminal holder in accordance with an exemplary embodiment.

FIG. 8 is a cross-sectional view of a portion of the power connector 100 showing the wire 114 poised for loading into the terminal holder 120. When assembled, the rear insert 202 is coupled to the rear of the terminal block 200, such as using the latches 214. The release mechanism 204 is located between the rear insert 202 and the terminal block 200. For example, the rear insert 202 includes an insert chamber 224 that receives a main body 232 of the release mechanism 204. The insert chamber 224 is located forward of a rear wall 226 of the rear insert 202. The insert chamber 224 may be oversized relative to the release mechanism 204 to allow space for the release mechanism 204 to move relative to the rear insert 202. For example, the release mechanism 204 may be slidable up and down within the insert chamber 224 between the un-actuated position and the actuated position. The wire ports 220 extend through the rear wall 226.

In an exemplary embodiment, the terminals 122 extend rearward from the terminal block 200 into the insert chamber 224. The wire 114 is configured to interface with the terminals 122. Each terminal 122 includes a terminating end 190. The terminating end 190 is received in a pocket 216 at the rear of the terminal block 200. The pocket may receive the end of the corresponding wire 114 to interface the wire 114 with the terminating end 190.

In an exemplary embodiment, the power connector 100 includes a biasing member 250 associated with each terminal 122. The biasing member 250 is located between the rear of the terminal block 200 and the rear insert 202. The biasing member 250 is configured to interface with the wire 114 with the wire 114 is poked into the terminal holder 120. The biasing member 250 is configured to press the wire 114 into electrical connection with the terminating end 190 of the terminal 122. The biasing member 250 is configured to hold the wire 114 in the terminal holder 120. In an exemplary embodiment, the release mechanism 204 is configured to operably engage the biasing member 250 to release the biasing member 250 from the wire 114 to allow removal of the wire 114.

In an exemplary embodiment, the biasing member 250 is a stamped and formed peace manufactured from a metal material, such as stainless steel. The biasing member 250 is deflectable and configured to be elastically deformed, such as when the wire 114 is poked into the terminal holder 120. The biasing member 250 has spring characteristics causing the biasing member 250 to be spring biased against the wire 114 when poked into the terminal holder 120. The biasing member 250 extends between a fixed end 252 and a free end 254 opposite the fixed end 252. The fixed end 252 is fixed relative to the terminal holder 120. The free end 254 is movable relative to the terminal holder 120. In the illustrated embodiment, the fixed end 252 is coupled to the terminal block 200. The biasing member 250 is cantilevered from the terminal block 200 in the insert chamber 224 such that the free end 254 is movable relative to the terminal block 200, the rear insert 202, the terminating end 190 of the terminal 122 and the wire 114. In an exemplary embodiment, the biasing member includes a pusher 256 at the free end 254. The pusher 256 is configured be biased against the wire 114 to push the wire 114 into direct physical contact with the terminating end 190 of the terminal 122. A separable interface 192 is defined between the wire 114 and the terminating end 190 to allow removal of the wire 114, such as when the release mechanism 204 is operated. In an exemplary embodiment, the pusher 256 is defined by an edge 258 of the biasing member 250 at the free end 254. The edge 258 is configured to bite against the conductor of the wire 114 to hold the wire 114 in the terminal holder 120. In the illustrated embodiment, the biasing member 250 has an inclined portion 260 it is inclined in the direction of wire loading. The inclined portion 260 positions the edge 258 to engage the wire 114 when the wire 114 is poked into the terminal holder 120. The inclined portion 260 orients the edge 258 to help retain the wire 114 in the terminal holder 120 and resist pullout of the wire 114. The biasing member 250 may have other shapes in alternative embodiments.

Figure 9:
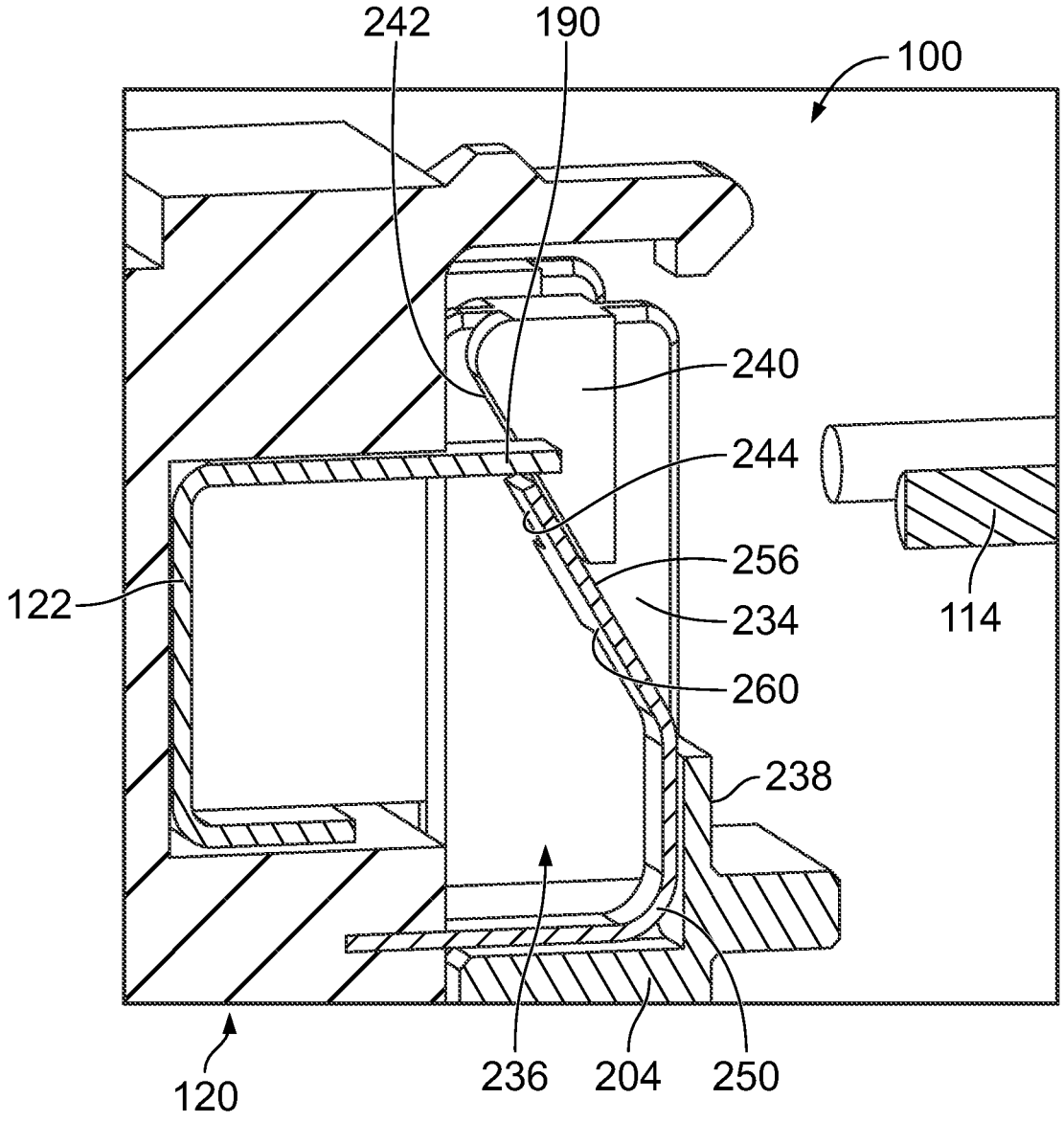
FIG. 9 is a cross-sectional view of a portion of the power connector showing the release mechanism with the rear insert removed for clarity to illustrate components of the release mechanism in accordance with an exemplary embodiment.

FIG. 9 is a cross-sectional view of a portion of the power connector 100 showing the release mechanism 204 with the rear insert 202 (shown in FIG. 8) removed for clarity to illustrate components of the release mechanism 204. The release mechanism 204 includes separating walls 234 forming pockets 236 that receive the corresponding biasing members 250. The terminating ends 190 of the terminals 122 extend into the corresponding pockets 236. The pockets 236 are configured to receive end of the wire 114 when the wire 114 is poked into the terminal holder 120.

In an exemplary embodiment, the release mechanism 204 includes pusher release elements 240 extending from the separating walls 234 into the pockets 236. The pusher release elements 240 are configured to interface with the biasing members 250 to release the biasing members 250 from the wire 114. For example, when the release mechanism 204 is operated and moved from the unactuated position to be actuated position, the pusher release elements 240 interface with the pushers 256 of the biasing members 250 to release the pushers 256 from the wire 114. For example, the pusher release elements 240 may force the pushers 256 and a releasing direction (for example, a downward direction). In the illustrated embodiment, the pusher release elements 240 include wedges 242. Each wedge 242 has a ramp surface is inclined relative to the wire loading direction. The ramp surface 244 may extend at an angle complementary to the angle of the inclined portion 260 of the biasing member 250. The wedges 240 20 are driven downward in a releasing direction to engage the inclined portion 260 and move the pusher 256 in a releasing direction. Other types of pusher release elements may be used in alternative embodiments. For example, the pusher release element 240 may be a cylindrical post or rod rather than a wedge. The pusher release elements may have other shapes in alternative embodiments.

In an exemplary embodiment, the release mechanism 204 includes a support wall 238 at the rear of the release mechanism 204. The support wall 238 is used to support the biasing member 250. For example, the support wall 238 may form a backup surface to stop rearward movement or pivoting of the biasing member 250. For example, the support wall 238 may support the pusher 256 to resist pullout of the wire 114 from the terminal holder 120.

Figure 10:
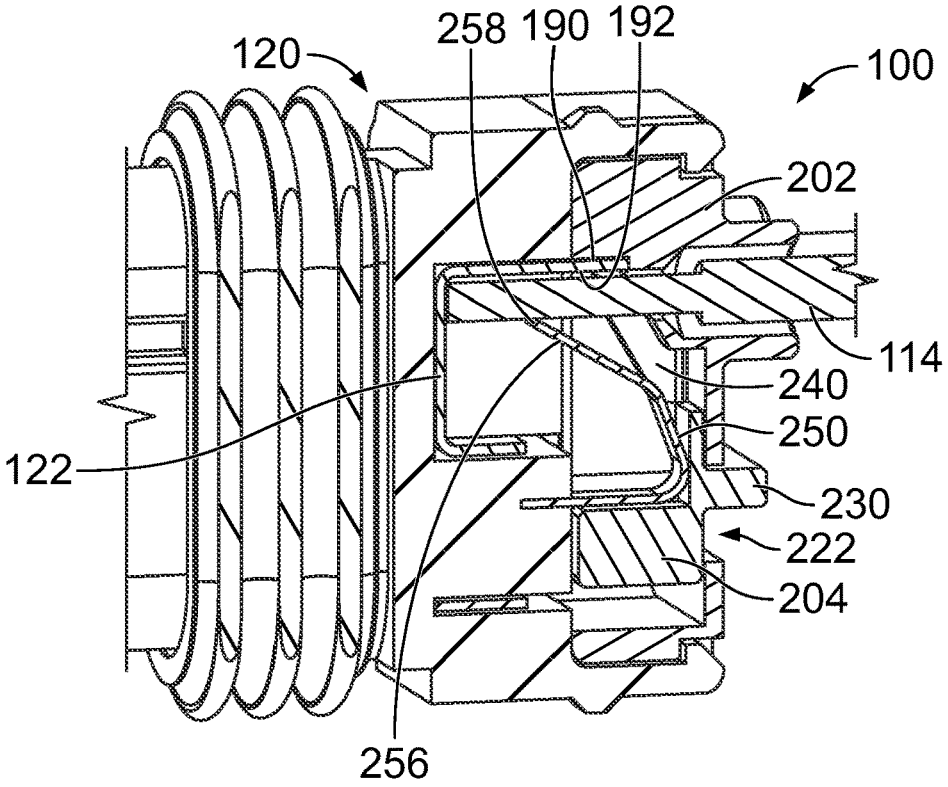
FIG. 10 is a cross-sectional view of a portion of the power connector showing the wire inserted into the terminal holder and electrically coupled to the terminals in accordance with an exemplary embodiment.
Figure 11:
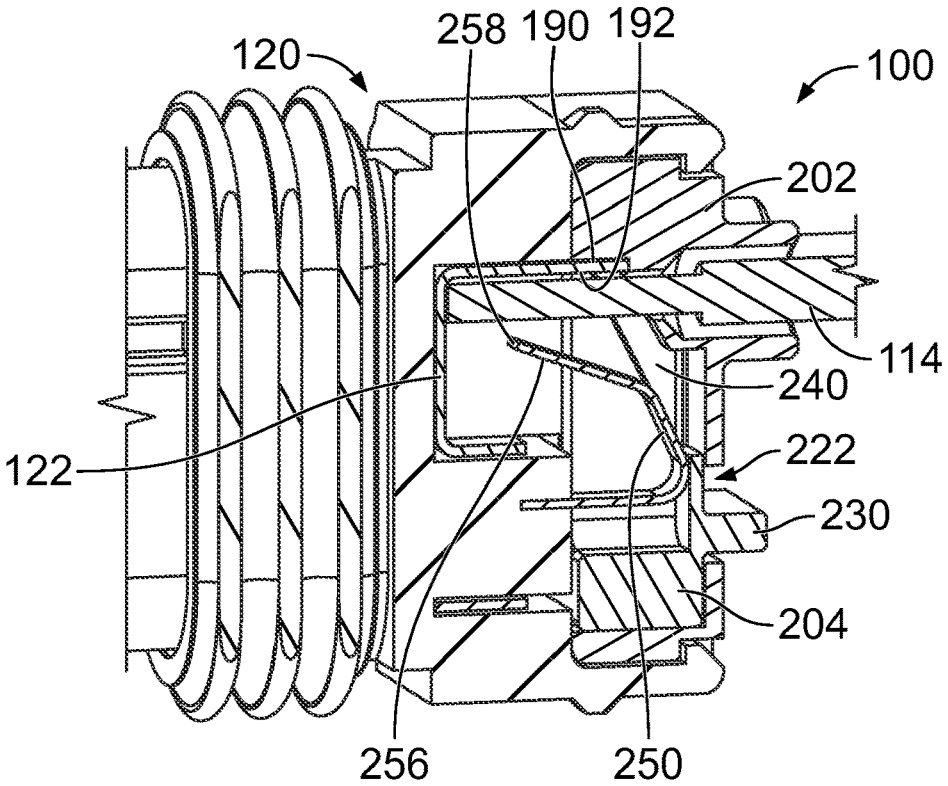
FIG. 11 is a cross-sectional view of a portion of the power connector showing the wire in the terminal holder in accordance with an exemplary embodiment.

FIG. 10 is a cross-sectional view of a portion of the power connector 100 showing the wire 114 inserted into the terminal holder 120 and electrically coupled to the terminals 122. FIG. 11 is a cross-sectional view of a portion of the power connector 100 showing the wire 114 in the terminal holder 120. FIG. 10 illustrates the release mechanism 204 in an unactuated position allowing the biasing members 250 to engage and retain the wire 114 in the terminal holder 120. FIG. 11 illustrates the release mechanism 204 in an actuated position to release the biasing members 250 from the wire 114 and allow the wire 114 to be removed from the terminal holder 120.

The release mechanism 204 is movable relative to the rear insert 202 from the unactuated position (FIG. 10) to the actuated position (FIG. 11). For example, the release mechanism 204 may be slid in a downward direction from the unactuated position to the actuated position. The lever 230 extends through the opening 222 in the rear insert 202 for access to the operator. The lever 230 may be pushed downward to move the release mechanism 204. Prior to actuation, the pusher 256 is spring biased against the wire 114 to push the wire 114 into electrical connection with the terminating end 190 of the terminal 122. The edge 258 bites into the conductor to prevent pullout of the wire 114. Actuation of the release mechanism 204 releases the biasing member 250 from the wire 114. In an exemplary embodiment, the release mechanism 204 simultaneously releases each of the biasing members 250 from the corresponding wires 110, 112, 114. As the release mechanism 204 is moved downward, the pusher release elements 240 engage the biasing member 250 to deflect the pusher 256 away from the wire 114. The wire 114 is then free to separate from the separable interface 192 of the terminals 122 and may be pulled rearwardly out of the terminal holder 120.

Figure 12:
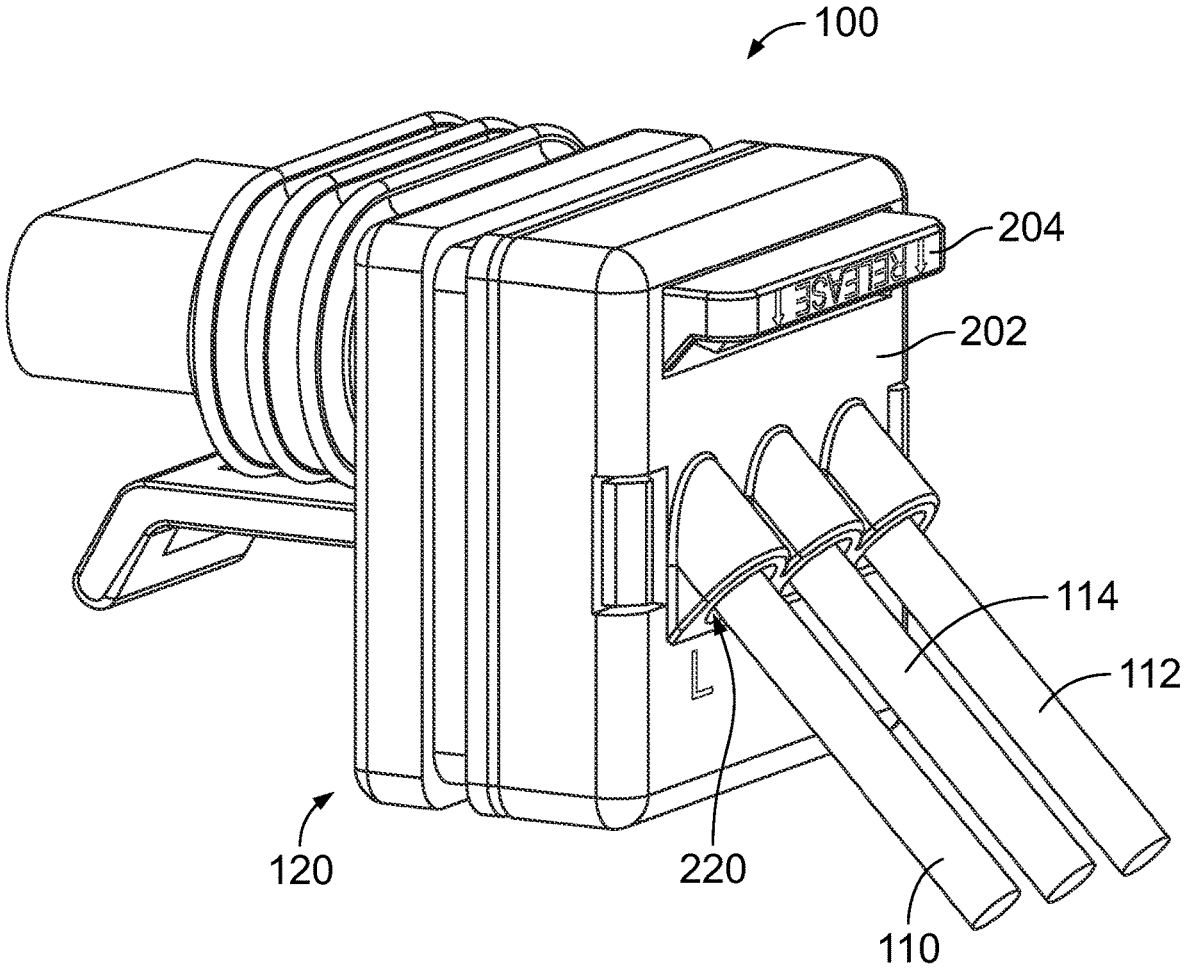
FIG. 12 is a perspective view of a portion of the power connector in accordance with an exemplary embodiment.

FIG. 12 is a perspective view of a portion of the power connector 100 in accordance with an exemplary embodiment. FIG. 12 illustrates an alternative terminal holder 120. For example, the rear insert 202 is shaped differently to receive the wires 110, 112, 114 in the wire ports 220 at a different angle, such as a nonorthogonal angle. The terminal holder 120 provides the release mechanism 204 above the wire ports 220 rather than below the wire ports 220. In an exemplary embodiment, the release mechanism 204 is a rocker rather than a slider. For example, the release mechanism 204 may be released by pivoting the release mechanism 204 rather than sliding the release mechanism in a downward direction.

Figure 13:
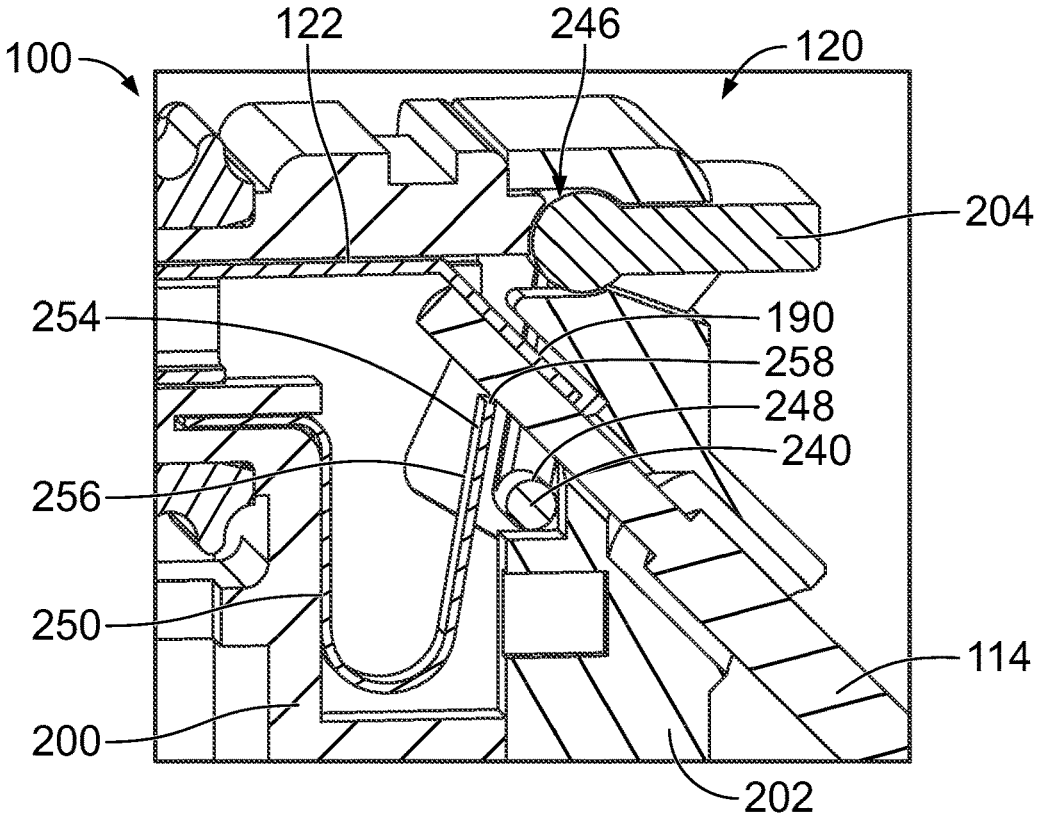
FIG. 13 is a cross-sectional view of a portion of the power connector shown in FIG. 12 in accordance with an exemplary embodiment.
Figure 14:
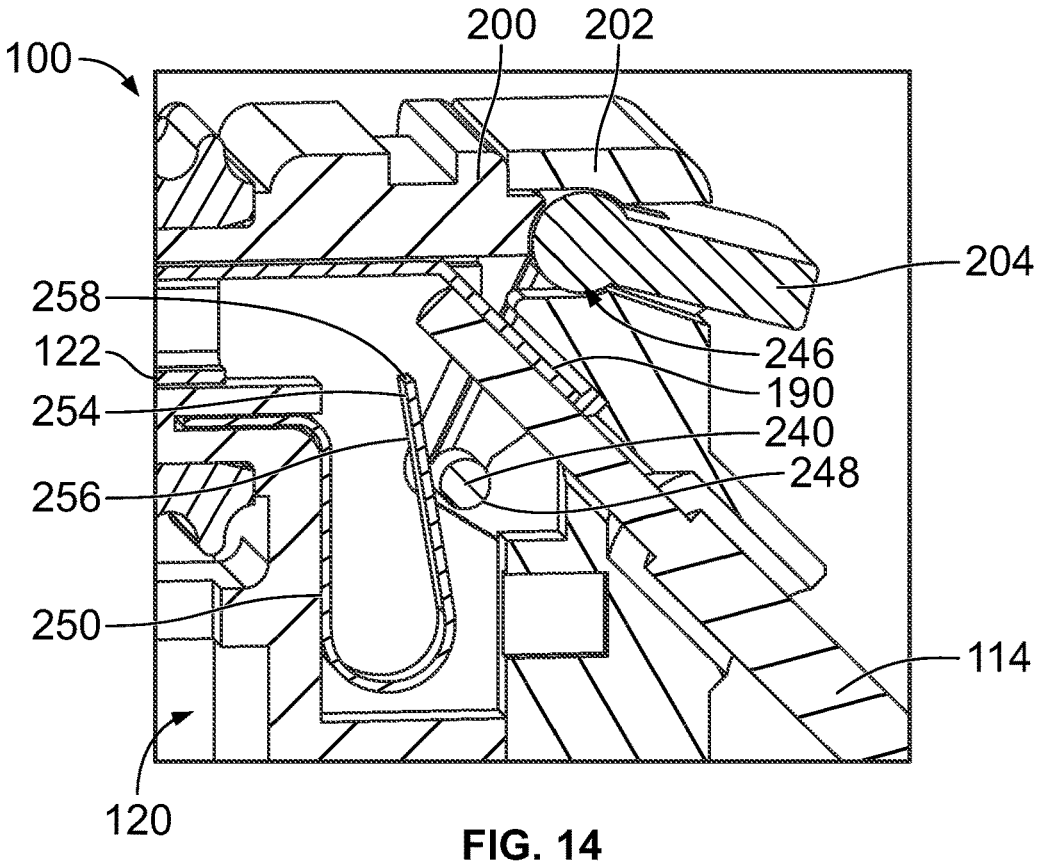
FIG. 14 is a cross-sectional view of a portion of the power connector shown in FIG. 12 in accordance with an exemplary embodiment.

FIG. 13 is a cross-sectional view of a portion of the power connector 100 shown in FIG. 12 in accordance with an exemplary embodiment. FIG. 14 is a cross-sectional view of a portion of the power connector 100 shown in FIG. 12 in accordance with an exemplary embodiment. FIG. 13 illustrates the release mechanism 204 in an unactuated position allowing the biasing members 250 to engage and retain the wire 114 in the terminal holder 120. FIG. 14 illustrates the release mechanism 204 in an actuated position to release the biasing members 250 from the wire 114 and allow the wire 114 to be removed from the terminal holder 120.

The release mechanism 204 is shaped differently than the release mechanism shown in FIG. 10. For example, the release mechanism 204 includes an axle 246 received in a pocket formed between the rear insert 202 and the terminal block 200. The axle 246 is rotatable relative to the rear insert 202 in the terminal block 200. As such, the release mechanism 204 may be released by pivoting the release mechanism 204 rather than sliding the release mechanism in a downward direction. The pusher release element 240 is rotated relative to the biasing member 250. In the illustrated embodiment, the pusher release element 240 includes a cylindrical bar 248 configured to engage and press against the biasing member 250, rather than the wedge 242 (shown in FIG. 10). The biasing member 250 is shaped differently in the illustrated embodiment. For example, the biasing member 250 is U-shaped. The free end 254 of the biasing member 250 extend generally vertically rather than being inclined. However, the wire insertion direction is angled transverse to the vertical free end 254 of the biasing member such that the end of the wire 114 extends across the free end 254 of the biasing member 250. The edge 258 is configured to bite into the conductor to hold the wire 114 in the terminal holder 120. The pusher 256 of the biasing member 250 pushes the wire 114 outward into electrical connection with the terminating end 190 of the terminal 122. The terminating end 190 of the terminal 122 is shaped differently in the illustrated embodiment to accommodate for the transverse poke in wire direction.

Figure 15:
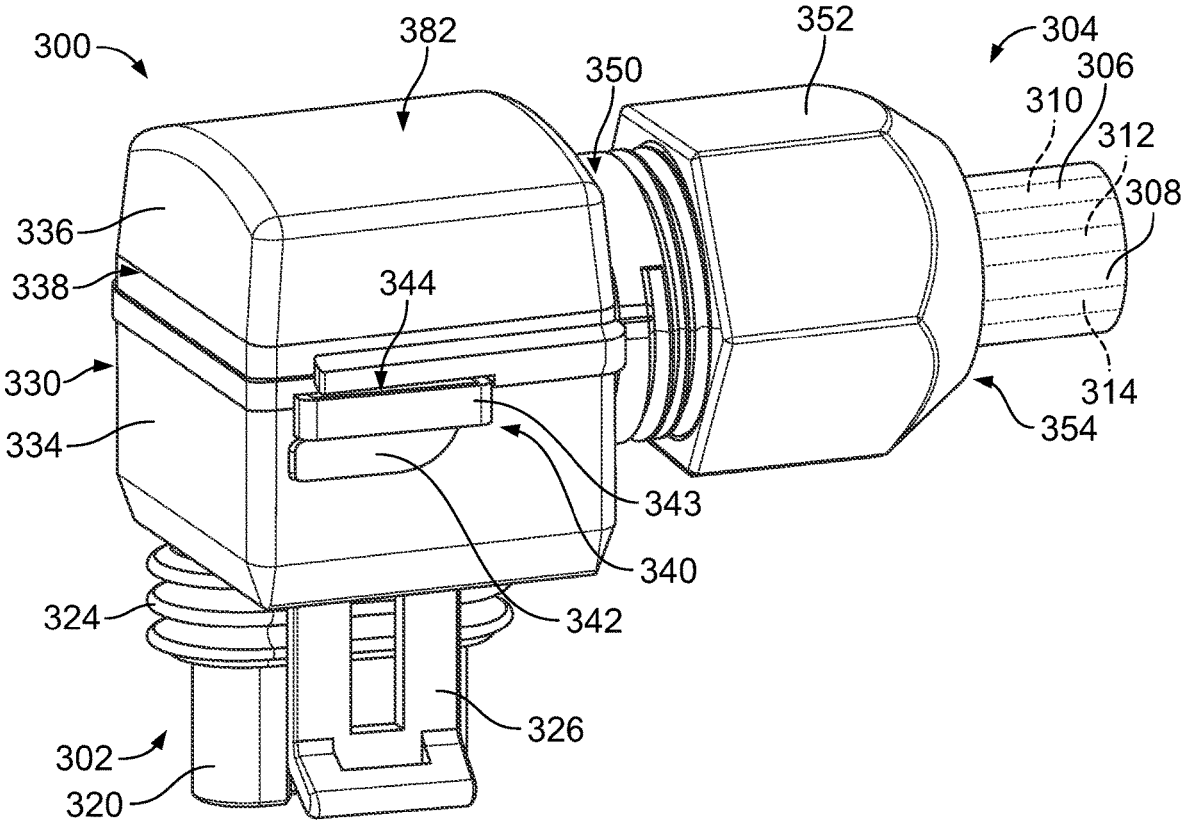
FIG. 15 illustrates a power connector in accordance with an exemplary embodiment.
Figure 16:
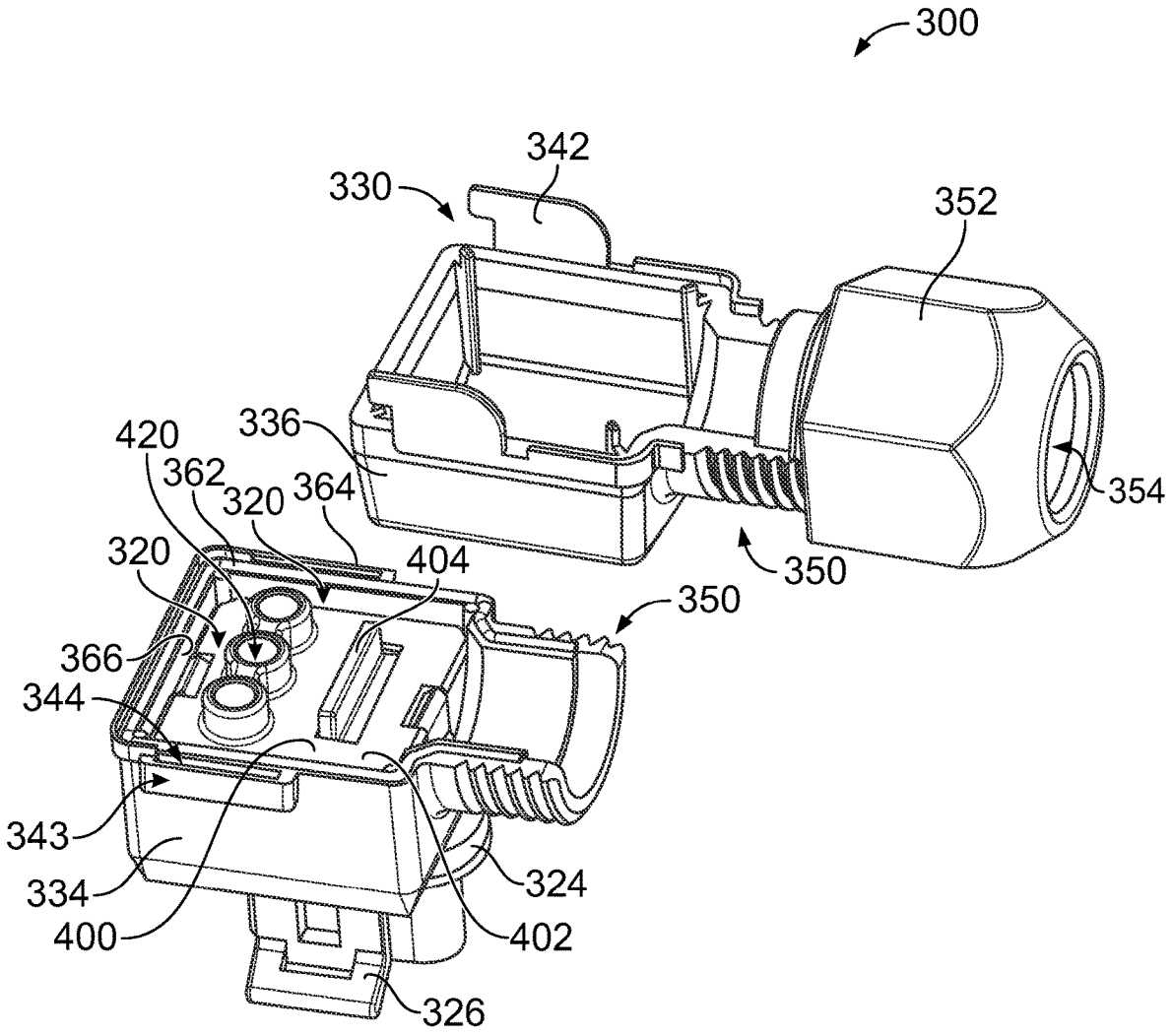
FIG. 16 is an exploded view of the power connector shown in FIG. 15 in accordance with an exemplary embodiment.

FIG. 15 illustrates a power connector 300 in accordance with an exemplary embodiment. FIG. 16 is an exploded view of the power connector 300 in accordance with an exemplary embodiment. The power connector 300 is similar to the power connector 100 and includes similar components. In an exemplary embodiment, the latching features and/or the sealing features of the power connector 300 may be formed and/or operate differently than the latching features and the sealing features of the power connector 100.

The power connector 300 extends between a mating end 302 and a cable end 304. The mating end 302 is configured to be mated with a mating power connector (not shown) and supplies power to the device or system through the mating power connector. A power cable 306 extends from the cable end 304 to supply power to the power connector 300. In an exemplary embodiment, the power cable 306 is a multi-wire power cable including multiple wires within a wire bundle within the power cable 306 surrounded by an outer jacket 308. In an exemplary embodiment, the wire bundle of the power cable 306 includes a line wire 310, a neutral wire 312, and a ground wire 314. In an exemplary embodiment, the power connector 300 provides a sealed mating interface with the mating power connector and a sealed interface with the power cable 306.

In an exemplary embodiment, the power connector 300 includes a terminal holder 320 holding a plurality of terminals (not shown). The terminal holder 320 and the terminals may be similar to or identical to the terminal holder 120 and the terminals 122 (shown in FIG. 1). The terminals are terminated to ends of the wires 310, 312, 314. The power connector 300 includes a front seal 324 around the exterior of the terminal holder 320 configured to be sealed to the mating power connector. The power connector 300 includes a latch 326 for latchably coupling the power connector 300 to the mating power connector.

In an exemplary embodiment, the power connector 300 includes a cable cover assembly 330 at least partially surrounding the terminal holder 320 and at least partially surrounding the end of the power cable 306. For example, the cable cover assembly 330 includes a shell 332 surrounding a portion of the terminal holder 320. The power cable 306 extends into the shell 332. In an exemplary embodiment, the shell 332 is a multipiece shell including a front cover 334 and a rear cover 336. The front cover 334 is coupled to the rear cover 336 at a seam 338. In an exemplary embodiment, the cable cover assembly 330 includes a seal 362 (FIG. 16) at the seam 338 to provide a sealed interface between the front cover 334 and the rear cover 336. In an exemplary embodiment, the rear cover 336 is configured to be pivotably coupled to the front cover 334 at a hinge 340. For example, the rear cover 336 may include hooks 342 and the front cover 334 may include latches 343 that form pockets 344 that receive the hooks 342. The hooks 342 are captured in the pockets 344 to resist front-to-rear movement and/or side-to-side movement and/or top-to-bottom movement. Other types of hinges or latches may be used in alternative embodiments. In other various embodiments, the front cover 334 may be secured to the rear cover 336 using other securing means, such as clips, fasteners, and the like. In the illustrated embodiment, the latching features are provided along the sides of the front and rear covers 334, 336. The latching features may be provided at other locations in alternative embodiments.

In an exemplary embodiment, the cable cover assembly 330 includes a threaded protrusion 350 at the cable end 304. A sealing nut 352 is threadably coupled to the threaded protrusion 350. The threaded protrusion 350 may include a cable bore 354 extending therethrough. The power cable 306 is received in the cable bore 354. The sealing nut 352 may be used to clamp the threaded protrusion 350 around the exterior of the outer jacket 308 of the power cable 306. In an exemplary embodiment, the threaded protrusion 350 is formed by the front cover 334 and the rear cover 336.

The shell 332 forms a chamber 360 that receives the terminal holder 320. In an exemplary embodiment, the chamber 360 is sealed by the perimeter seal 362 extending around the perimeter of the front cover 334, such as at edges 364 of perimeter walls 366 of the front cover 334. The perimeter seal 362 is configured to interface with the rear cover 336 when the rear cover 336 is coupled to the front cover 334.

The terminal holder 320 holds the terminals and is configured to receive ends of the wires 310, 312, 314 to create electrical connections between the wires 310, 312, 314 in the terminals. In an exemplary embodiment, the terminal holder 320 is a multipiece housing. For example, the terminal holder 320 includes a terminal block 400 at a front of the terminal holder 320 and a rear insert 402 at a rear of the terminal holder 320. In an exemplary embodiment, a release mechanism 404 is coupled to the terminal block 400 and/or the rear insert 402 to release the wires 310, 312, 314 from the terminal holder 320. In an exemplary embodiment, the single release mechanism 404 is used to release all of the wires 310, 312, 314. For example, upon actuation of the release mechanism 404, all of the wires 310, 312, 314 may be simultaneously released from the terminal holder 320.

The terminal block 400 includes terminal channels 410 receiving the terminals. The front of the terminal block 400 extend forward of the cable cover assembly 330 for mating with the mating power connector. The front seal 324 extends around the front portion of the terminal block 400 located forward of the cable cover assembly 330. In an exemplary embodiment, the latch 326 extends from the terminal block 400. The rear insert 402 is coupled to a rear end of the terminal block 400. The rear insert 402 includes wire ports 420 that receive the wires 310, 312, 314. In an exemplary embodiment, the wires 310, 312, 314 are poked into the wire ports 420 to mate with the terminals 322.

Figure 17:
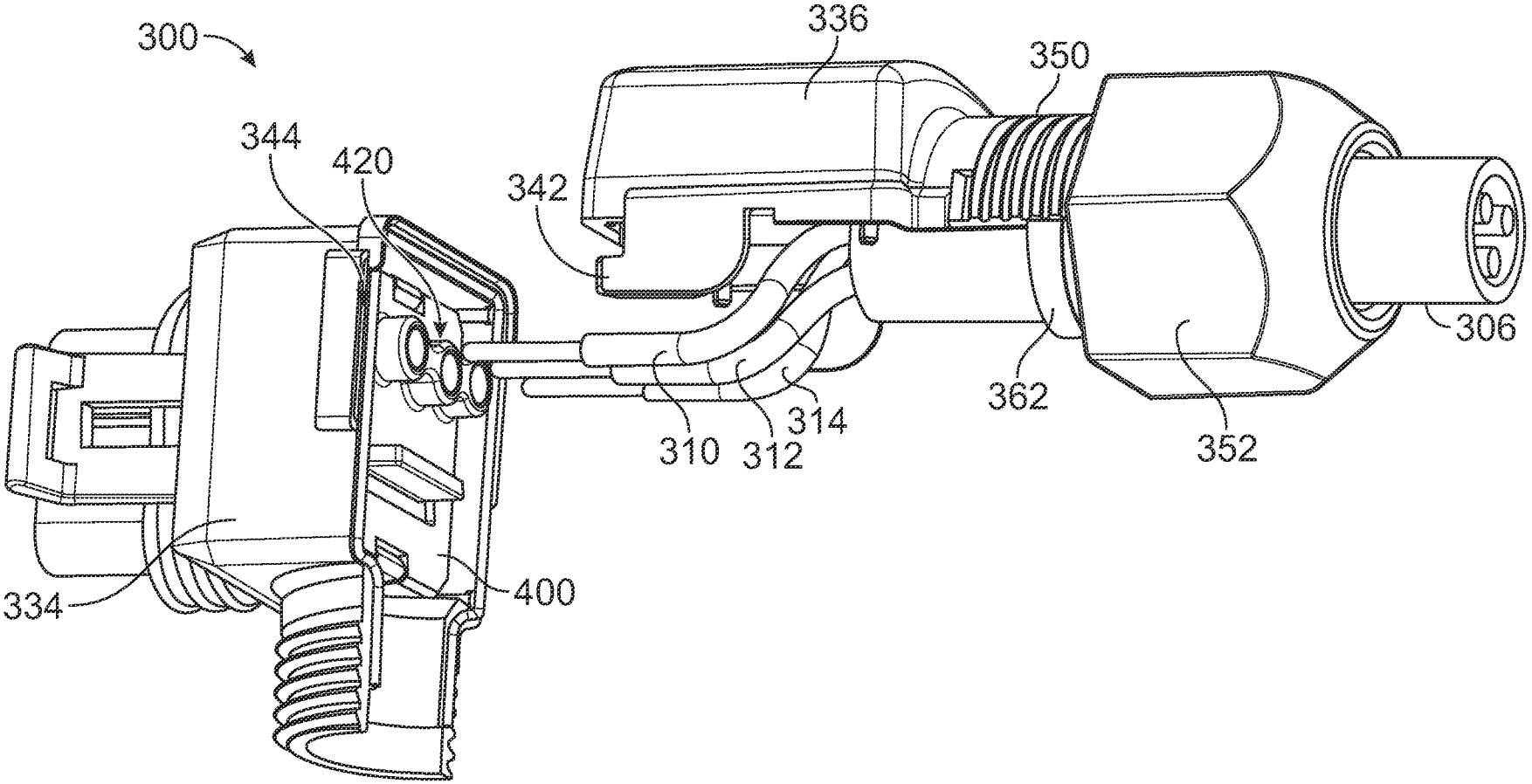
FIG. 17 is an exploded view of the power connector shown in FIG. 15 showing the power connector partially assembled in accordance with an exemplary embodiment.
Figure 18:
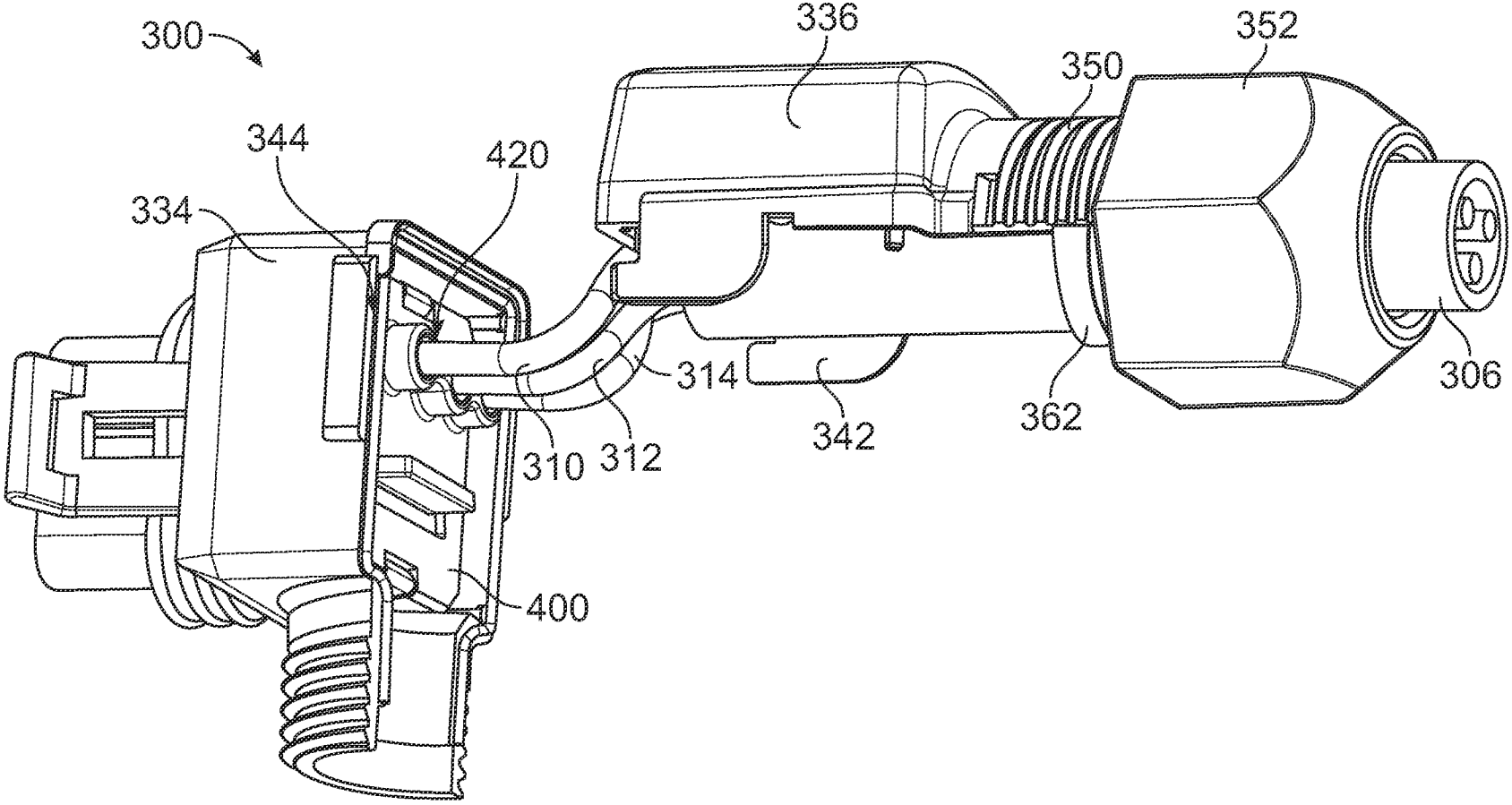
FIG. 18 is an exploded view of the power connector shown in FIG. 15 showing the power connector partially assembled in accordance with an exemplary embodiment.

FIG. 17 is an exploded view of the power connector 300 showing the power connector partially assembled in accordance with an exemplary embodiment. FIG. 18 is an exploded view of the power connector 300 showing the power connector partially assembled in accordance with an exemplary embodiment. FIG. 17 shows the wires 310, 312, 314 poised for loading into the wire ports 420. FIG. 18 shows the wires 310, 312, 314 poked into the wire ports 420 and electrically connected to the terminals.

During assembly, the terminal block 400 is loaded into the front cover 334. The sealing nut 352 is loaded onto the end of the power cable 306. The end of the power cable 306 is received in the bore of the rear cover 336. The exposed ends of the wires 310, 312, 314 are aligned with the wire ports 420 and configured to be poked into the wire ports 420. After the wires 310, 312, 314 are coupled to the terminal block 400, the rear cover 336 is coupled to the front cover 334 by loading the hooks 342 into the pockets 344 and then rotating the rear cover 336 closed. After the front and rear covers 334, 336 are coupled together, the sealing nut 352 is threadably coupled to the threaded portion 350 to secure the front and rear covers 334, 336 and compress the seal 362.

Figure 19:
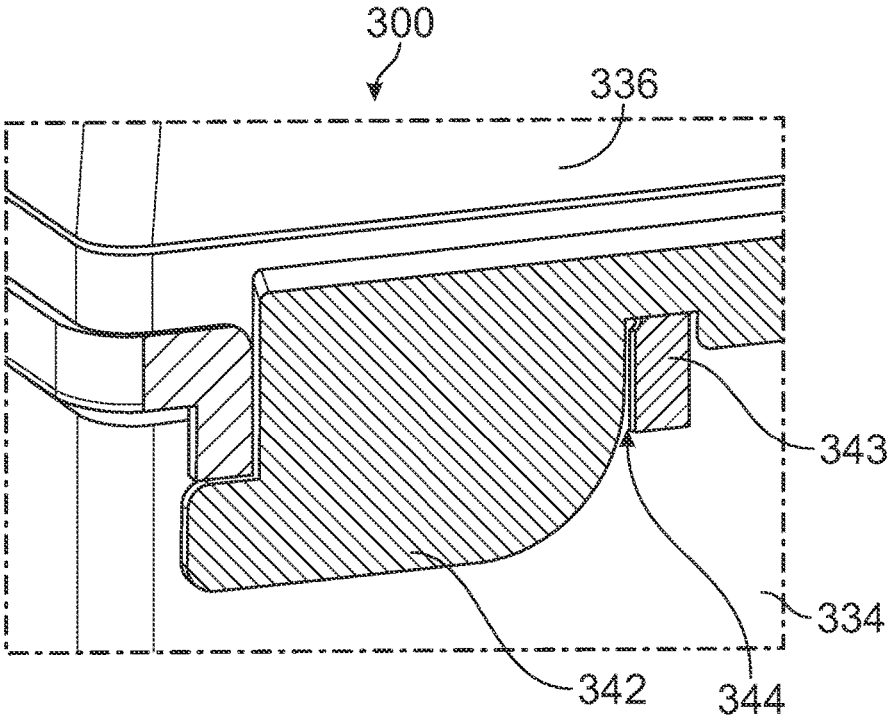
FIG. 19 is a cross sectional view of a portion of the power connector shown in FIG. 15 in accordance with an exemplary embodiment.

FIG. 19 is a cross sectional view of a portion of the power connector 300 showing the latching features of the front and rear covers 334, 336 in accordance with an exemplary embodiment. The rear cover 336 is coupled to the front cover 334 by loading the hook 342 into the latch 343. The hooks 342 are captured in the pockets 344 to resist front-to-rear movement and/or side-to-side movement and/or top-to-bottom movement.

Figure 20:
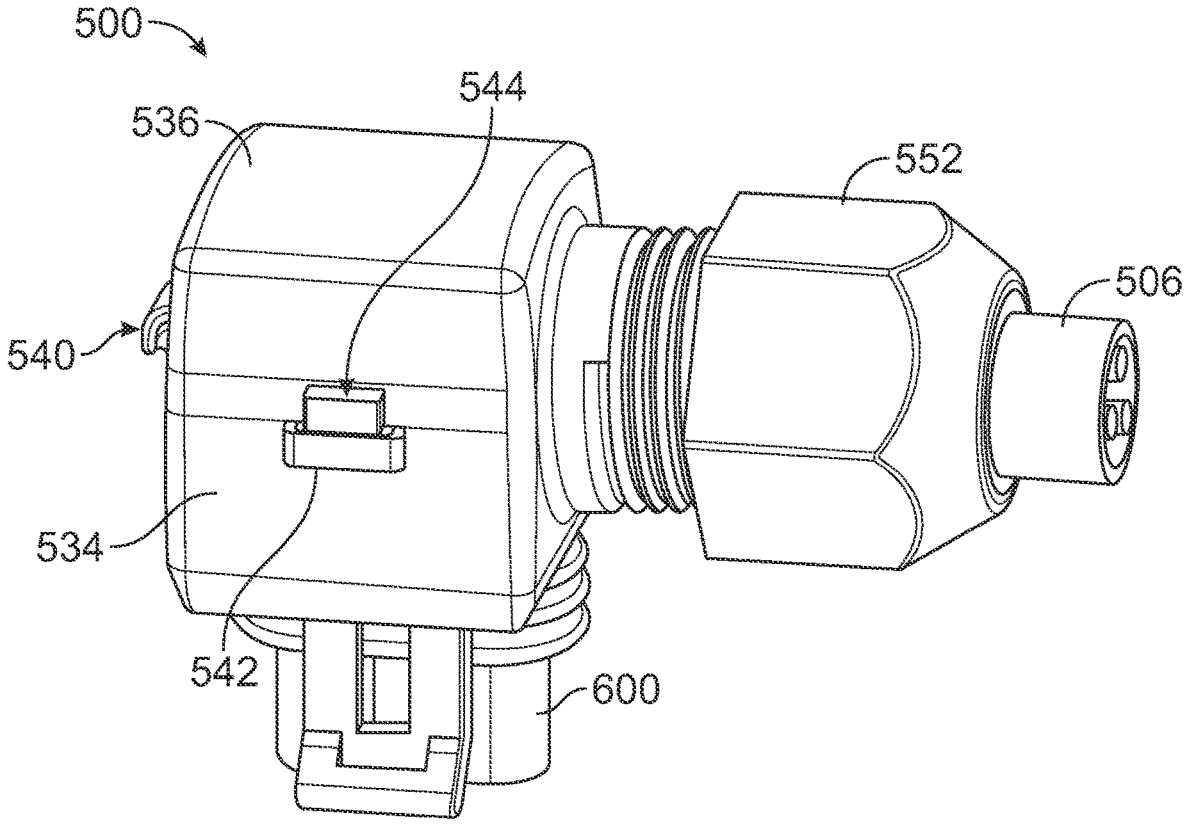
FIG. 20 illustrates a power connector in accordance with an exemplary embodiment.

FIG. 20 illustrates a power connector 500 in accordance with an exemplary embodiment. The power connector 500 is similar to the power connector 100 (FIG. 1) and the power connector 300 (FIG. 15) and includes similar components. In an exemplary embodiment, the latching features and/or the sealing features of the power connector 500 may be formed and/or operate differently than the latching features and the sealing features of the power connectors 100, 300.

In an exemplary embodiment, the power connector 500 includes a hinge 540 at an end of the power connector 500 and latching features 542, 544 at sides of the power connector 500 to secure front and rear covers 534, 536 of the power connector 500. The front and rear covers 534, 536 are hingedly coupled together at the hinge 540. The latching features 542, 544 of the front and rear covers 534, 536 interface with each other to position and/or secure the front and rear covers 534, 536 together. For example, the latching feature 544 of the rear cover 536 is received in the pocket formed by the latching feature 542 of the front cover 534. The hinge 540 and the latching features resist front-to-rear movement and/or side-to-side movement and/or top-to-bottom movement. Other types of hinges or latches may be used in alternative embodiments.

Figure 21:
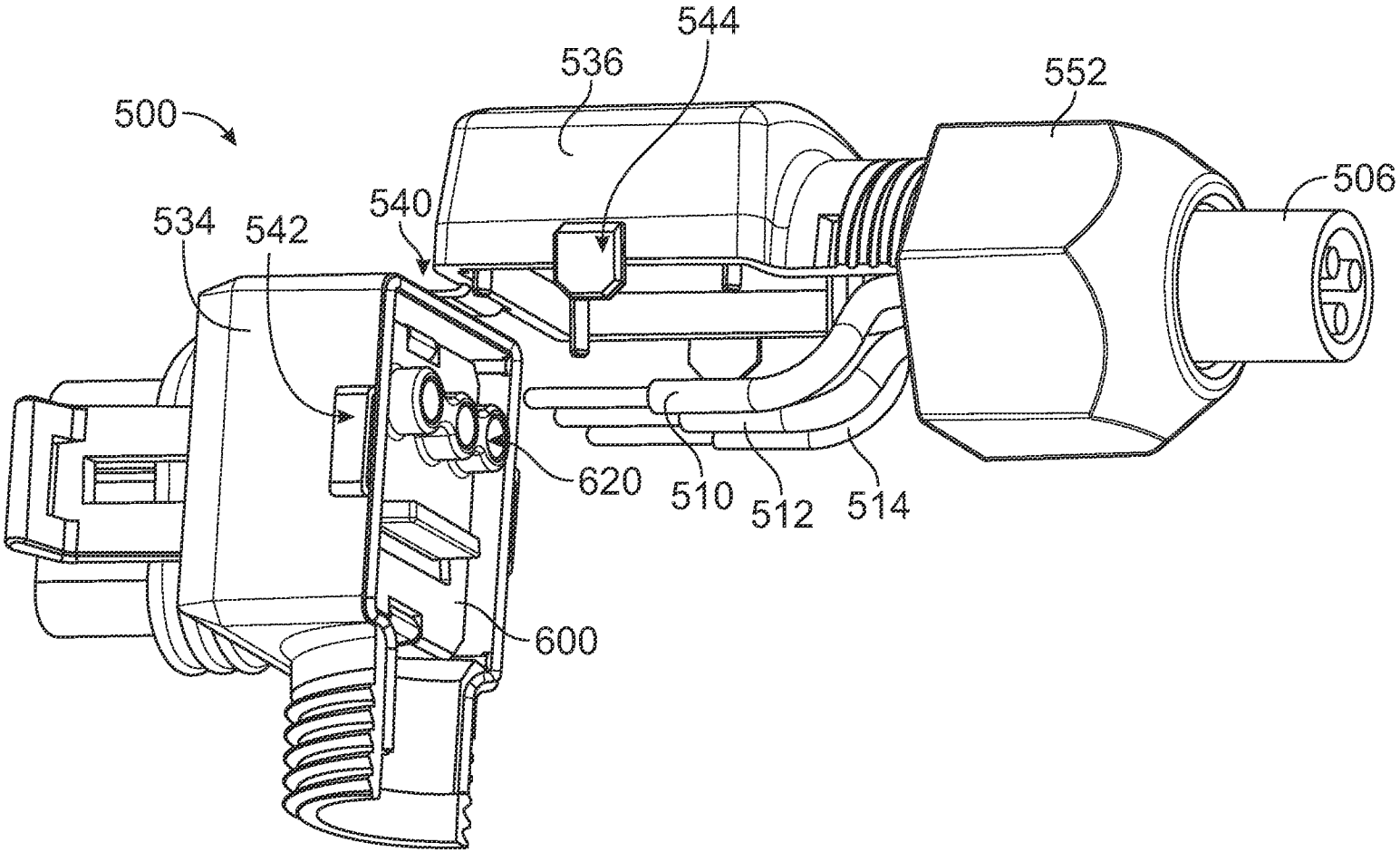
FIG. 21 is an exploded view of the power connector shown in FIG. 20 showing the power connector partially assembled in accordance with an exemplary embodiment.
Figure 22:
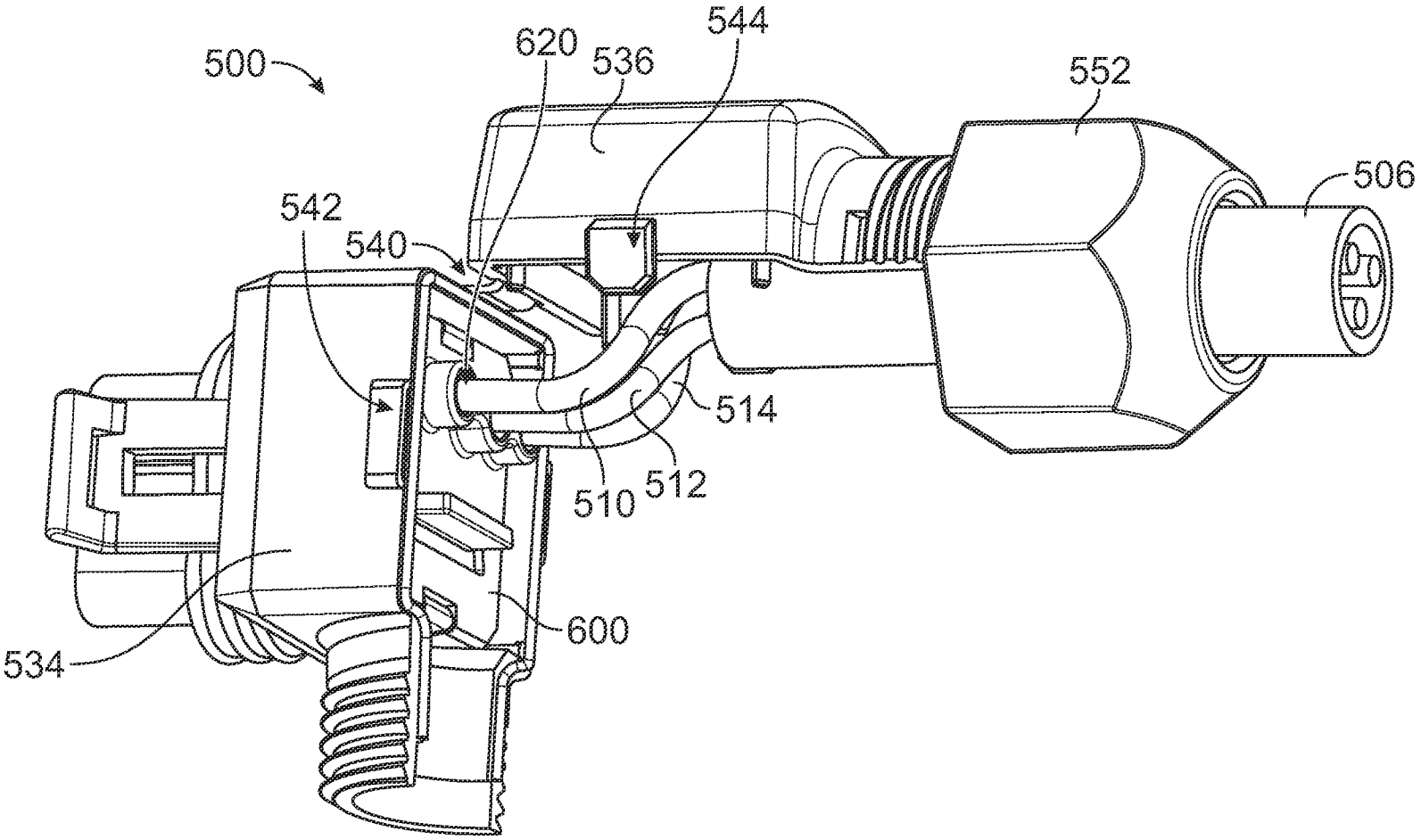
FIG. 22 is an exploded view of the power connector shown in FIG. 20 showing the power connector partially assembled in accordance with an exemplary embodiment.

FIG. 21 is an exploded view of the power connector 500 showing the power connector 500 partially assembled in accordance with an exemplary embodiment. FIG. 22 is an exploded view of the power connector 500 showing the power connector 500 partially assembled in accordance with an exemplary embodiment. FIG. 21 shows wires 510, 512, 514 poised for loading into wire ports 620 of a terminal block 600. FIG. 22 shows the wires 510, 512, 514 poked into the wire ports 620 and electrically connected to the terminals (not shown).

During assembly, the terminal block 600 is loaded into the front cover 534. A sealing nut 552 is loaded onto the end of the power cable 506. The end of the power cable 506 is received in the bore of the rear cover 536. The exposed ends of the wires 510, 512, 514 are aligned with the wire ports 620 and configured to be poked into the wire ports 620. After the wires 510, 512, 514 are coupled to the terminal block 600, the rear cover 536 is coupled to the front cover 534 by connecting the latching features 542, 544. After the front and rear covers 534, 536 are closed, the sealing nut 552 is threadably coupled to the threaded portions of the front and rear covers 534, 536.

Figure 23:
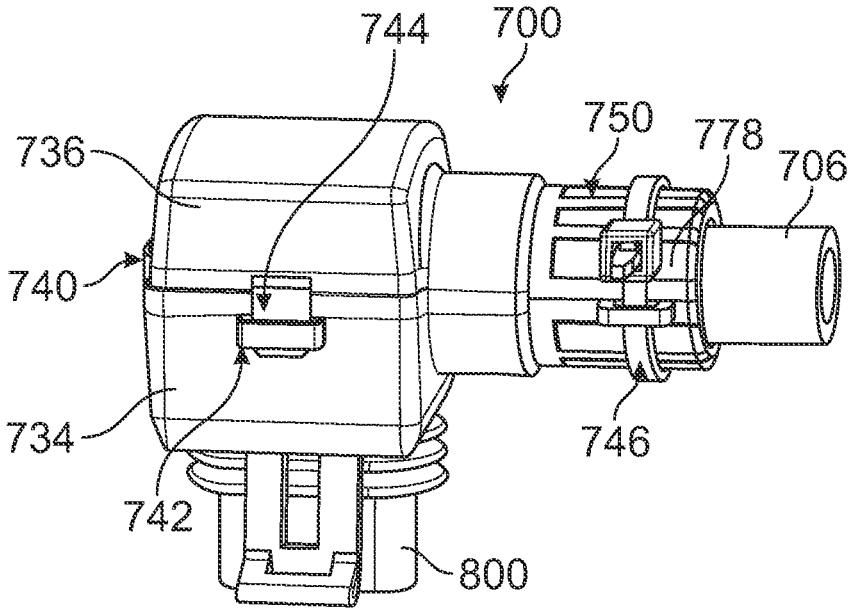
FIG. 23 illustrates a power connector in accordance with an exemplary embodiment.

FIG. 23 illustrates a power connector 700 in accordance with an exemplary embodiment. The power connector 700 is similar to the power connector 100 (FIG. 1), the power connector 300 (FIG. 15), and the power connector 500 (FIG. 20) and includes similar components. In an exemplary embodiment, the latching features and/or the sealing features of the power connector 700 may be formed and/or operate differently than the latching features and the sealing features of the power connectors 100, 300, 500.

In an exemplary embodiment, the power connector 700 includes end latching features 740 at an end of the power connector 700 and side latching features 742, 744 at sides of the power connector 700. The latching features 740, 742, 744 secure front and rear covers 734, 736 of the power connector 700. The latching features 740, 742, 744 of the front and rear covers 734, 736 interface with each other to position and/or secure the front and rear covers 734, 736 together. For example, the latching feature 744 of the rear cover 736 is received in the pocket formed by the latching feature 742 of the front cover 734. The latching features 740, 742, 744 resist front-to-rear movement and/or side-to-side movement and/or top-to-bottom movement. Other types of hinges or latches may be used in alternative embodiments.

Figure 24:
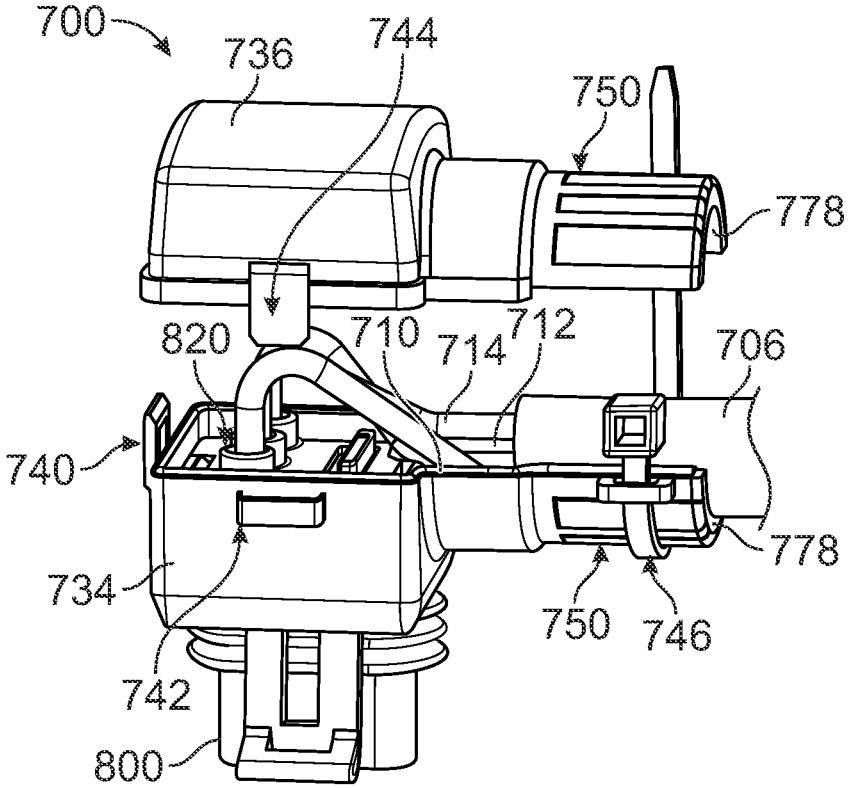
FIG. 24 is an exploded view of the power connector shown in FIG. 23 showing the power connector partially assembled in accordance with an exemplary embodiment.

FIG. 24 is an exploded view of the power connector 700 showing the power connector 700 partially assembled in accordance with an exemplary embodiment. FIG. 24 shows wires 710, 712, 714 of the power cable 706 poked into wire ports 820 of a terminal block 800 and electrically connected to the terminals (not shown).

During assembly, the rear cover 736 is coupled to the front cover 734 by connecting the latching features 740, 742, 744. The rear cover 736 may be mated in a vertical mating direction to the end of the front cover 734. After the front and rear covers 734, 736 are closed, a securing feature 746 is coupled to the protrusion 750 at the cable end to secure the cable ends of the front and rear covers 734, 736. For example, the securing feature 746 may be a zip tie that is tightened to hold the front and rear covers 734, 736 together. In an exemplary embodiment, a cable seal 778 is provided at the cable end. The cable seal 778 may be integrated into the cable end of the front and rear covers 734, 736. For example, the cable seal 778 may be co-molded with the front and rear covers 734, 736. Alternatively, the cable seal 778 may be a sealing grommet separately received in the protrusion 750. The cable seal 778 may be compressible against the outer jacket of the power cable 706 when the securing feature 746 is tightened.

Figure 25:
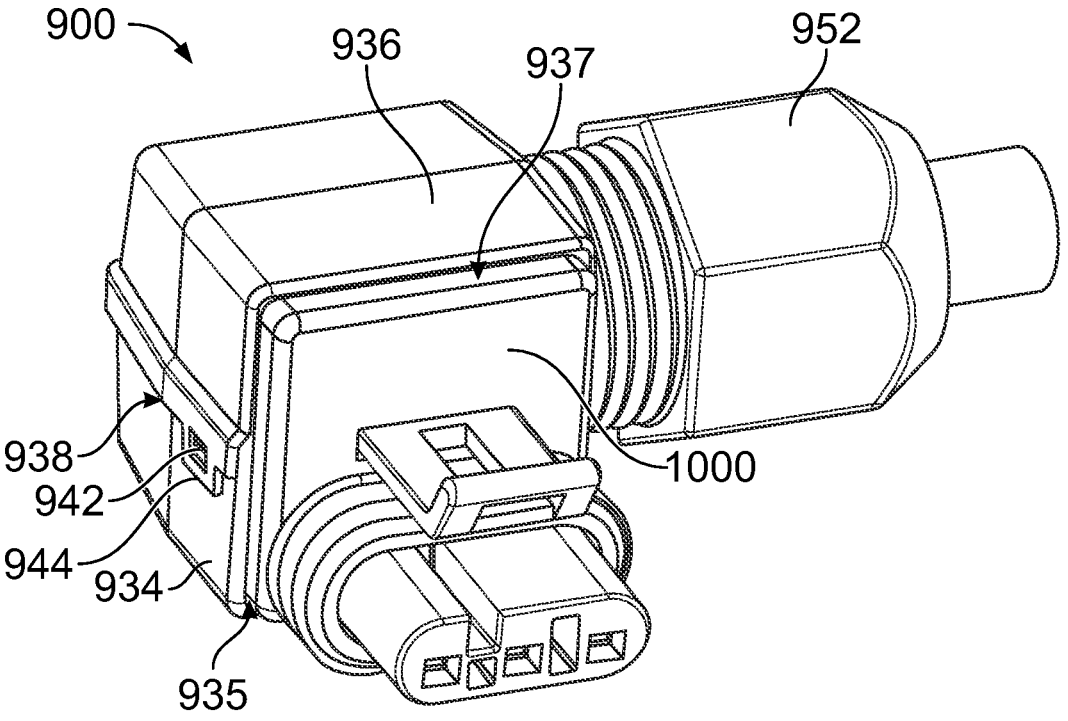
FIG. 25 illustrates a power connector in accordance with an exemplary embodiment.

FIG. 25 illustrates a power connector 900 in accordance with an exemplary embodiment. The power connector 900 is similar to the power connector 100 (FIG. 1) and includes similar components. In an exemplary embodiment, the power connector 900 holds a terminal block 1000 in the housing in a different manner than the previous embodiments. For example, the terminal block 1000 is held between front and rear covers 934, 936 and extends through openings in both the front and rear covers 934, 936 rather than just extending through an opening in the front cover.

In an exemplary embodiment, the power connector 900 includes latching features 942, 944 on the front and rear covers 934, 936, respectively, to secure the front and rear covers 934, 936 together. Other types of hinges or latches may be used in alternative embodiments. The front and rear covers 934, 936 meet at a seam 938 to capture the terminal block 1000 therebetween. The front cover 934 includes an opening 935 and the rear cover 936 includes an opening 937. The terminal block 1000 passes through the openings 935, 937.

Figure 26:
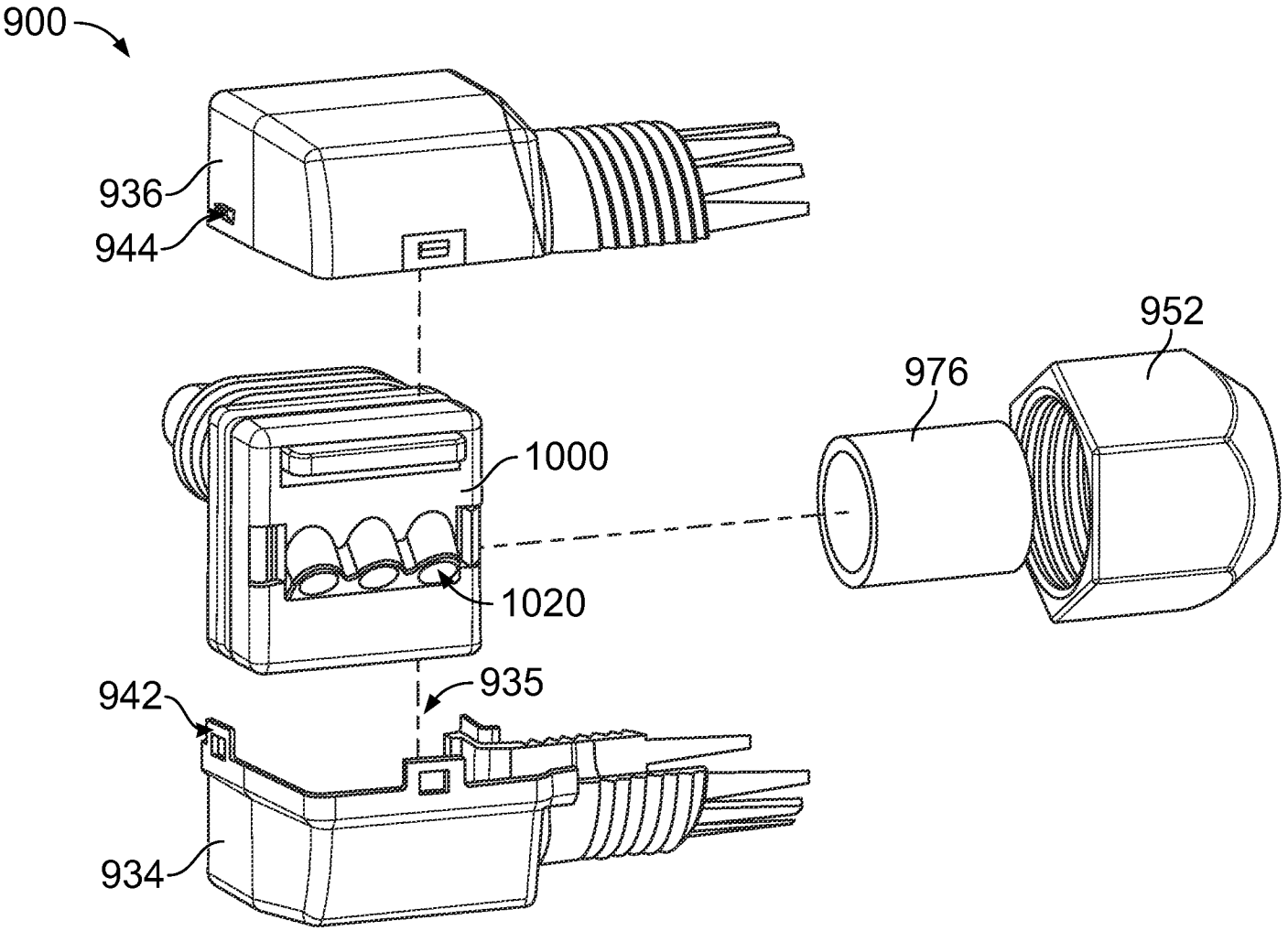
FIG. 26 is an exploded view of the power connector shown in FIG. 25 in accordance with an exemplary embodiment.

FIG. 26 is an exploded view of the power connector 900 in accordance with an exemplary embodiment. The terminal block 1000 is positioned between the front and rear covers 934, 936. The terminal block 1000 includes wire ports 1020 configured to receive wires of the power cable, such as via a poke-in wire connection with terminals of the terminal block 1000. A sealing grommet 976 is configured to be received in the cable ends of the front and rear covers 934, 936 to seal to the power cable. A sealing nut 952 is configured to be loaded onto the cable ends of the front and rear covers 934, 936 and is threadably coupled to the threaded portions of the front and rear covers 934, 936 to seal the front and rear covers 934, 936 against the sealing grommet 976.

Figure 27:
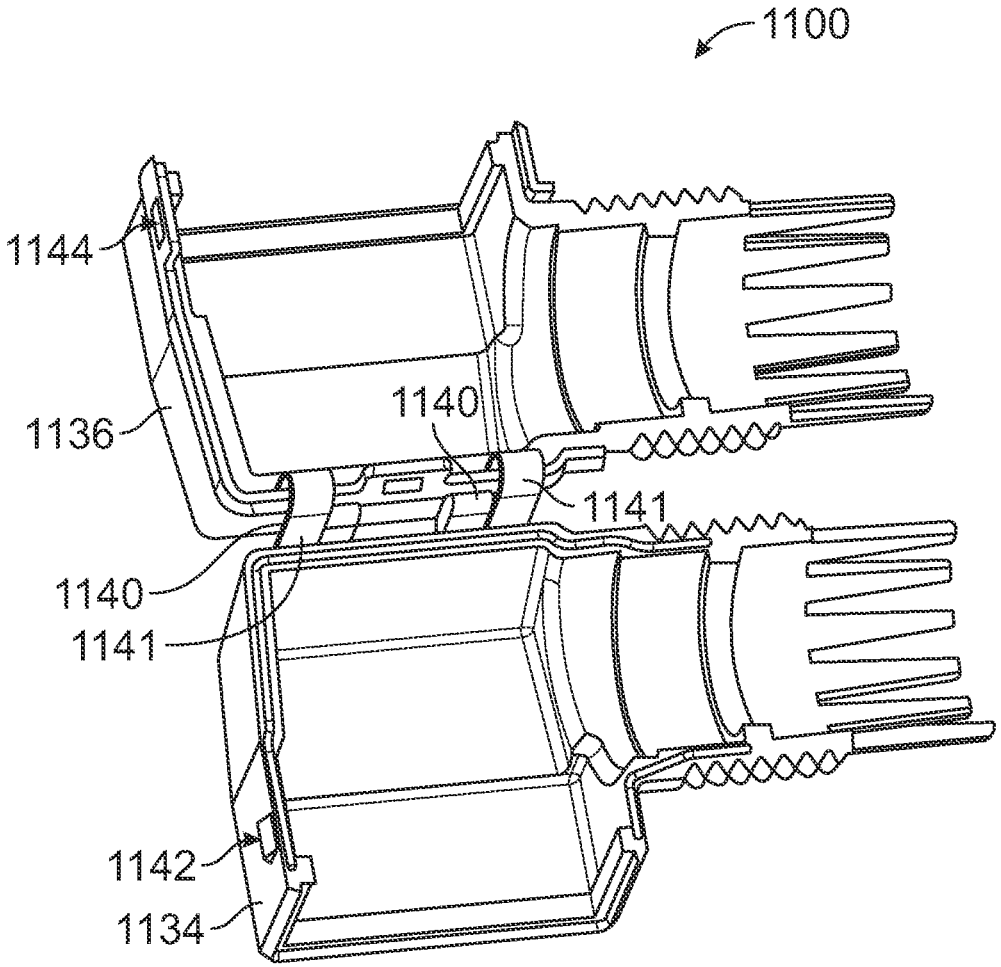
FIG. 27 illustrates a power connector in accordance with an exemplary embodiment.
Figure 28:
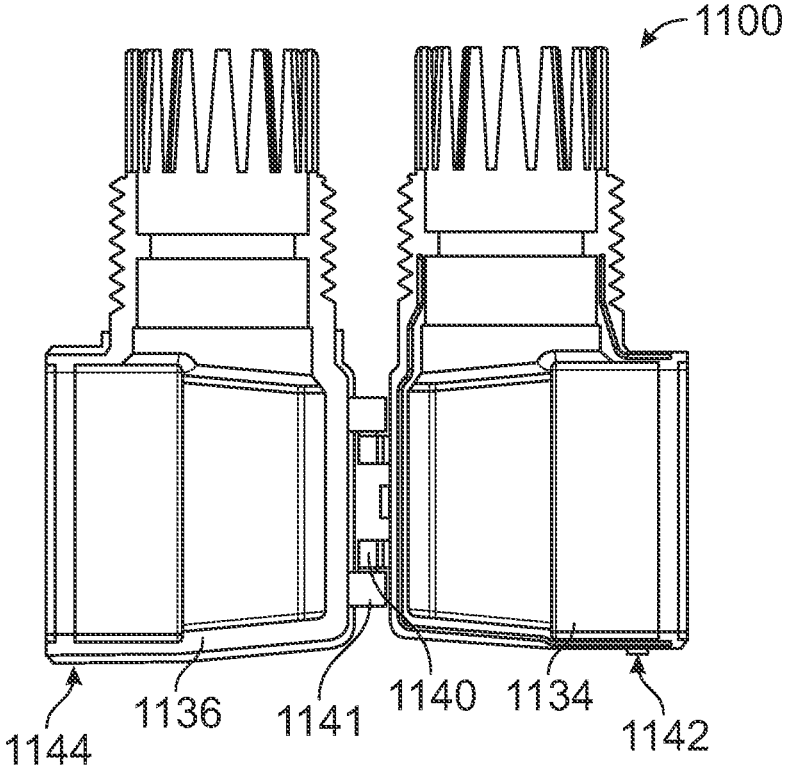
FIG. 28 is a top view of the power connector shown in FIG. 27 in accordance with an exemplary embodiment.
Figure 29:
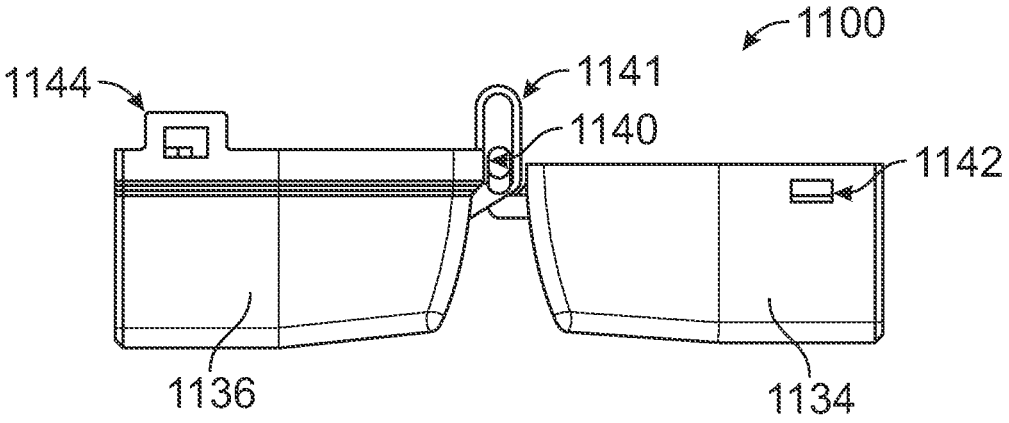
FIG. 29 is an end view of the power connector shown in FIG. 27 in accordance with an exemplary embodiment.

FIG. 27 illustrates a power connector 1100 in accordance with an exemplary embodiment. FIG. 28 is a top view of the power connector 1100 shown in FIG. 27 in accordance with an exemplary embodiment. FIG. 29 is an end view of the power connector 1100 shown in FIG. 27 in accordance with an exemplary embodiment. The power connector 1100 is similar to the power connector 900 (FIG. 25) and includes similar components; however, the power connector 1100 includes a hinged connection between front and rear covers 1134, 1136.

In an exemplary embodiment, the front cover 1134 includes hinge rods 1140 and the rear cover 1136 includes hinge brackets 1141 that receive the hinge rods 1140. The hinge brackets 1141 are rotatable on the hinge rods 1140. In an exemplary embodiment, the pockets of the hinge brackets 1141 are elongated allowing the rear cover 1136 to move linearly on the hinge rods 1140 in addition to rotating on the hinge rods 1140. For example, during mating, the rear cover 1136 may be rotated to an aligned position relative to the front cover 1134, but spaced apart from the front cover 1134. The rear cover 1136 may then be moved forward to mate with the front cover 1134. Latching features 1142, 1144 on the front and rear covers 1134, 1136, respectively, secure the front and rear covers 1134, 1136 together. Other types of hinges or latches may be used in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power connector comprising:

a terminal block including terminal channels with separating walls between the terminal channels, the terminal block extending between a front and a rear;

terminals received in the terminal channels, each terminal including a mating end and a terminating end, the mating end configured for mating with a mating terminal, the terminating ends of the terminals configured to be electrically coupled to corresponding wires at separable interfaces, the terminating ends provided at the rear;

a rear insert coupled to the rear and covering the terminating ends of the terminals, the rear insert including wire ports configured to receive the corresponding wires, wherein the wires are configured to be poked into the wire ports to interface with the terminating ends of the terminals;

biasing members associated with the terminals, the biasing members located between the rear of the terminal block and the rear insert, each biasing member including a pusher configured to be biased against the wire to push the wire into direct physical contact with the separable interface at the terminating end of the corresponding terminal; and a release mechanism including a plurality of pusher release elements, each pusher release element being associated with the pusher of the corresponding biasing member, the release mechanism being actuated to release the pushers of each of the biasing members from the corresponding wires, wherein the release mechanism includes a lever, the lever being actuated by a user to move each of the pusher release elements to release the pushers from the wires.

2. The power connector of claim 1, wherein the release mechanism moves each of the pushers simultaneously.

3. The power connector of claim 1, wherein the release mechanism is movable between an unactuated position and an actuated position, the pusher release elements moving each of the pushers when the release mechanism is moved from the unactuated position to the actuated position.

4. The power connector of claim 1, wherein the release mechanism is slidably coupled to the rear insert, the release mechanism sliding between an unactuated position and an actuated position, the pusher release elements moving each of the pushers when the release mechanism is moved from the unactuated position to the actuated position.

5. The power connector of claim 1, wherein the release mechanism is rotatably coupled to the rear insert, the release mechanism being rotated from an unactuated position to an actuated position, the pusher release elements moving each of the pushers when the release mechanism is moved from the unactuated position to the actuated position.

6. The power connector of claim 1, wherein the release mechanism includes pockets and separating walls located between the pockets, each pocket receiving one of the corresponding biasing members and the terminating end of one of the corresponding terminals, the pusher release elements extending into the corresponding pockets to engage the corresponding pushers.

7. The power connector of claim 1, wherein the biasing members are cantilevered from the rear of the terminal block, each biasing member including a fixed end coupled to the terminal block and a free end opposite the fixed end, the free end being deflectable relative to the terminal block, the free end defining the corresponding pusher configured to engage the wire poked into the wire port.

8. The power connector of claim 1, wherein the pusher release elements include wedges angled transverse to the wire poke in direction, the release mechanism being movable relative to the rear insert to drive the wedges into the biasing members to move the biasing members.

9. The power connector of claim 1, further comprising a cable cover assembly having a chamber receiving the terminal block, the cable cover assembly including a threaded protrusion having a cable bore configured to receive a cable including the wires in a wire bundle, the cable cover assembly including a sealing grommet received in the cable bore to seal between the threaded protrusion and the cable, the cable cover assembly including a sealing nut coupled to the threaded protrusion to clamp the threaded protrusion to the cable.

10. The power connector of claim 1, further comprising a cable cover assembly having a chamber receiving the terminal block, the cable cover assembly including a front cover and a rear cover separate and discrete from the front cover, the rear cover being coupled to the front cover at a seam, the cable cover assembly including a seal at the seam.

11. The power connector of claim 10, wherein the front shell is coupled to the rear shell at a hinge.

12. The power connector of claim 10, wherein the front shell is secured the rear shell using latching features.

13. A power connector comprising:

a terminal block including terminal channels with separating walls between the terminal channels, the terminal block extending between a front and a rear;

terminals received in the terminal channels, each terminal including a mating end and a terminating end, the mating end configured for mating with a mating terminal, the terminating ends of the terminals configured to be electrically coupled to corresponding wires at separable interfaces, the terminating ends provided at the rear;

a rear insert coupled to the rear and covering the terminating ends of the terminals, the rear insert including wire ports configured to receive the corresponding wires, wherein the wires are configured to be poked into the wire ports to interface with the terminating ends of the terminals;

biasing members associated with the terminals, the biasing members located between the rear of the terminal block and the rear insert, each biasing member including a pusher configured to be biased against the wire to push the wire into direct physical contact with the separable interface at the terminating end of the corresponding terminal, wherein the biasing members are cantilevered from the rear of the terminal block, each biasing member including a fixed end coupled to the terminal block and a free end opposite the fixed end, the free end being deflectable relative to the terminal block, the free end defining the corresponding pusher configured to engage the wire poked into the wire port; and a release mechanism including a plurality of pusher release elements, each pusher release element being associated with the pusher of the corresponding biasing member, the release mechanism being actuated to release the pushers of each of the biasing members from the corresponding wires, wherein the release mechanism is slidably coupled to the rear insert, the release mechanism sliding between an unactuated position and an actuated position, the pusher release elements moving each of the pushers when the release mechanism is moved from the unactuated position to the actuated position.

14. The power connector of claim 13, wherein the release mechanism moves each of the pushers simultaneously.

15. The power connector of claim 13, further comprising a cable cover assembly having a chamber receiving the terminal block, the cable cover assembly including a threaded protrusion having a cable bore configured to receive a cable including the wires in a wire bundle, the cable cover assembly including a sealing grommet received in the cable bore to seal between the threaded protrusion and the cable, the cable cover assembly including a sealing nut coupled to the threaded protrusion to clamp the threaded protrusion to the cable.

16. The power connector of claim 13, wherein the release mechanism includes a lever, the lever being actuated by a user to move each of the pusher release elements to release the pushers from the wires.

17. The power connector of claim 13, further comprising a cable cover assembly having a chamber receiving the terminal block, the cable cover assembly including a front cover and a rear cover separate and discrete from the front cover, the rear cover being coupled to the front cover at a seam, the cable cover assembly including a seal at the seam.

18. The power connector of claim 17, wherein the front shell is coupled to the rear shell at a hinge.

19. A power connector comprising:

a terminal block including terminal channels with separating walls between the terminal channels, the terminal block extending between a front and a rear;

terminals received in the terminal channels, each terminal including a mating end and a terminating end, the mating end configured for mating with a mating terminal, the terminating ends of the terminals configured to be electrically coupled to corresponding wires at separable interfaces, the terminating ends provided at the rear;

a rear insert coupled to the rear and covering the terminating ends of the terminals, the rear insert including wire ports configured to receive the corresponding wires, wherein the wires are configured to be poked into the wire ports to interface with the terminating ends of the terminals;

biasing members associated with the terminals, the biasing members located between the rear of the terminal block and the rear insert, each biasing member including a pusher configured to be biased against the wire to push the wire into direct physical contact with the separable interface at the terminating end of the corresponding terminal; and a release mechanism including a plurality of pusher release elements, each pusher release element being associated with the pusher of the corresponding biasing member, the release mechanism being actuated to release the pushers of each of the biasing members from the corresponding wires; and a cable cover assembly having a chamber receiving the terminal block, the cable cover assembly including a protrusion having a cable bore configured to receive a cable including the wires in a wire bundle, the wires exiting through the cable bore, the cable cover assembly including a sealing grommet along the cable bore to seal between the protrusion and the cable, the cable cover assembly including a securing feature coupled to the protrusion to clamp the protrusion to the cable.

20. The power connector of claim 19, wherein the release mechanism moves each of the pushers simultaneously.

21. The power connector of claim 19, wherein the cable cover assembly includes a front cover and a rear cover separate and discrete from the front cover, the rear cover being coupled to the front cover at a seam, the cable cover assembly including a seal at the seam, the front shell including a front cable seat, the rear shell including a rear cable seat, the power cable being sealed along the front cable seat and the rear cable seat.

22. The power connector of claim 21, wherein the front shell is coupled to the rear shell at a hinge.

* * * * *